United States Patent [19]

Furney et al.

[11] 4,290,055

[45] Sep. 15, 1981

[54] SCANNING CONTROL SYSTEM

[75] Inventors: Douglas E. Furney; Michael J. Muldrey, both of Lakewood, Colo.

[73] Assignee: Technical Development LTD, Hamilton, Bermuda

[21] Appl. No.: 100,574

[22] Filed: Dec. 5, 1979

[51] Int. Cl.[3] ..... G08B 19/00

[52] U.S. Cl. ..... 340/518; 340/505; 340/524

[58] Field of Search ..... 340/150, 152 R, 167 R, 340/167 A, 500, 505, 506, 517, 518, 521, 523, 527, 524

[56] References Cited

U.S. PATENT DOCUMENTS 3,566,399 2/1971 Weld ..... 340/505

3,958,240 5/1976 Richardson ..... 340/518

*Primary Examiner*—Alvin H. Waring

*Attorney, Agent, or Firm*—O'Rourke & Harris

[57] ABSTRACT

A scanning control system is disclosed for remotely sensing or monitoring a predetermined condition or state, such as the presence of a fire, by means of one or a multiplicity of detecting stations at one or a multiplicity of locations with each detecting station providing a positive indication of the location of each predetermined condition sensed. A scanning or control panel is electrically connected with the detecting stations by means of four wires extending from the panel regardless of the number of detecting stations utilized in the system. Two of the four wires are power and return leads from the scanning panel to all of the detecting stations, a third wire provides an interrogation pulse with the first detecting station receiving an interrogation pulse from the scanning panel and each succeeding detector station receiving an interrogation pulse generated by the preceding detector station at a predetermined later time following receipt of the interrogation pulse from the preceding detector station, and the fourth wire carries a pulse train of timewise spaced data pulses generated by the detecting stations in response to receipt of an interrogation pulse. Each data pulse generated by each detecting station is controlled as to pulse width so as to be indicative of the presence or absence of the condition being monitored, such as the presence or absence of a fire. The data pulses are processed at the scanning panel and an alarm generated if the pulses are indicative of a sensed condition such as a fire. Provision is also made for visually indicating the location or locations of all sensed conditions causing the alarm.

31 Claims, 22 Drawing Figures

SCANNING CONTROL SYSTEM

FIELD OF THE INVENTION

This invention relates to a condition sensing system and, more particularly, relates to a scanning system for monitoring a plurality of remote locations to sense a condition such as a fire thereat.

BACKGROUND OF THE INVENTION

It is oftentimes desirable to remotely monitor particular locations, including objects or live subjects thereat, to determine or ascertain a condition or a change in condition. Such might be the case, for example, in monitoring a location for the presence of a condition such as fire, high or low temperature, radiation, and/or light or the condition of a live subject to determine a change in condition such as in temperature, heart rate, or pulse rate.

The desirability of monitoring buildings and the like for early detection of abnormal and/or unwanted conditions such as a fire is well known and various devices and/or systems have heretofore been suggested and/or utilized to provide for such detection. In addition, some such systems have provided information as to the location of the detected condition.

Where a single or only a few detector stations are necessary, the problem of detecting the location of a condition such as a sensed fire is not overly troublesome, but when the number of stations is increased, the problem becomes more difficult, and has heretofore resulted either in complicated and expensive systems, complicated and expensive wiring between stations, and/or in systems that could not adequately handle the problem.

Alarm monitoring systems with remote detectors are shown, for example, in U.S. Pat. Nos. 3,189,882; 3,553,730; 3,566,399 and 3,735,396. Alarm monitoring systems utilizing time delayed responses are shown, by way of example, in U.S. Pat. Nos. 3,233,232 and 3,508,260.

Alarm monitoring systems utilizing variable pulse widths to trigger an alarm condition are shown, again by way of example, in U.S. Pat. Nos. 3,293,605 and 3,392,374. Other examples of signals utilized for indicating an alarm condition include utilizing the absence of a signal (U.S. Pat. No. 3,426,348); using voltage or current differentials (U.S. Pat. Nos. 3,676,877; 4,032,907; 4,041,455 and 4,095,220); using frequency differentials (U.S. Pat. No. 3,886,534); using a combination of synchronization and energizing pulses (U.S. Pat. No. 4,030,095); using pulse duration modulated signals (U.S. Pat. No. 3,940,739); using pulse position modulation (U.S. Pat. Nos. 3,689,888 and 3,940,739); and using pulses for sequential interrogation of remote transmitters (U.S. Pat. Nos. 3,278,920; 3,611,361 and 4,067,008).

SUMMARY OF THE INVENTION

This invention provides a system for detecting a condition such as a fire that is relatively simple yet is reliable and capable of quickly detecting the condition. The system utilizes a multiplicity of detector stations to detect the location or locations of the condition with the detector stations being connected to one another and to a control unit by means of only four wires to power, interrogate and convey data pulses between the detecting stations and the control panel.

It is therefore an object of this invention to provide an improved condition detector system.

It is another object of this invention to provide an improved scanning system for monitoring a plurality of detector stations to sense a predetermined condition at a plurality of locations.

It is yet another object of this invention to provide an improved sensing system that is relatively simple and uncomplicated but yet is reliable.

It is still another object of this invention to provide an improved scanning system utilizing only four wires for interconnecting the scanning panel and detector stations.

It is yet another object of this invention to provide an improved system for generating and utilizing timewise spaced pulses in a data train to indicate the presence and location of predetermined conditions.

It is still another object of this invention to provide an improved scanning system that is capable of detecting the presence of a plurality of predetermined conditions and indicating the presence and location of each.

It is yet another object of this invention to provide an improved fire detecting system.

It is still another object of this invention to provide an improved fire control scanning system for monitoring a plurality of detector stations.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
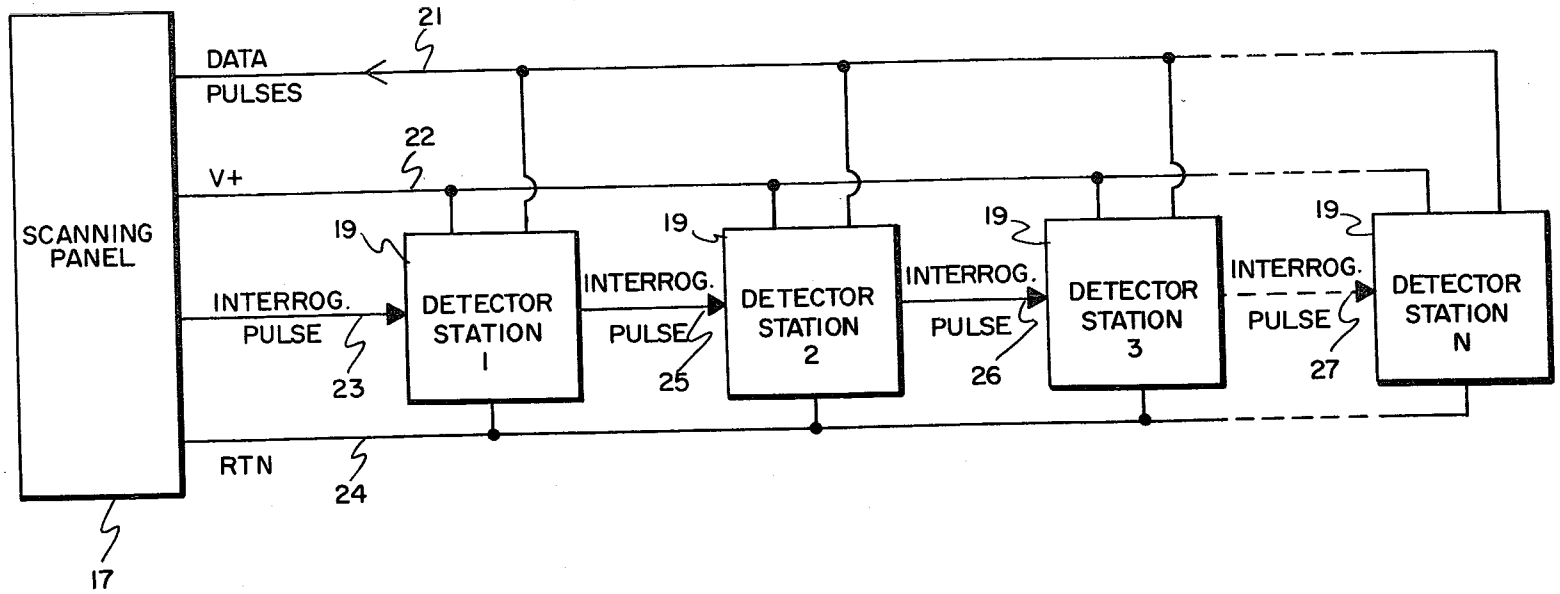
FIG. 1 is a block diagram of the control system of this invention.

The control scanning system of this invention is shown in block form in FIG. 1. As shown, a scanning, or control, panel 17 is electrically connected to a plurality of detector stations 19 (designated as 1, 2, 3 and N in FIG. 1) by means of four electrical leads 21, 22, 23 and 24.

Electrical lead 21 is connected to receive the data pulse output from each detector station and couple the train of data pulses therefrom to scanning panel 17. Electrical lead 22 provides V+ voltage to each detector station, while electrical lead 24 provides a return voltage path to the scanning panel. Electrical lead 23 provides an interrogation pulse from the scanning panel to the first detector station, which first detector station then timewise later generates an interrogation pulse that is coupled by lead 25 to the second detector station, which second station then timewise later generates an interrogation pulse that is coupled by electrical lead 26 to the third detector station, which third detector station then timewise later generates an interrogation pulse which is coupled by electrical lead 27 to the last (N) detector station. The number of stations utilized, of course, will vary depending upon the particular need. In the particular embodiment shown herein, the system is capable of handling up to 999 detector stations, but could be modified to handle a greater number if needed.

Figure 2:
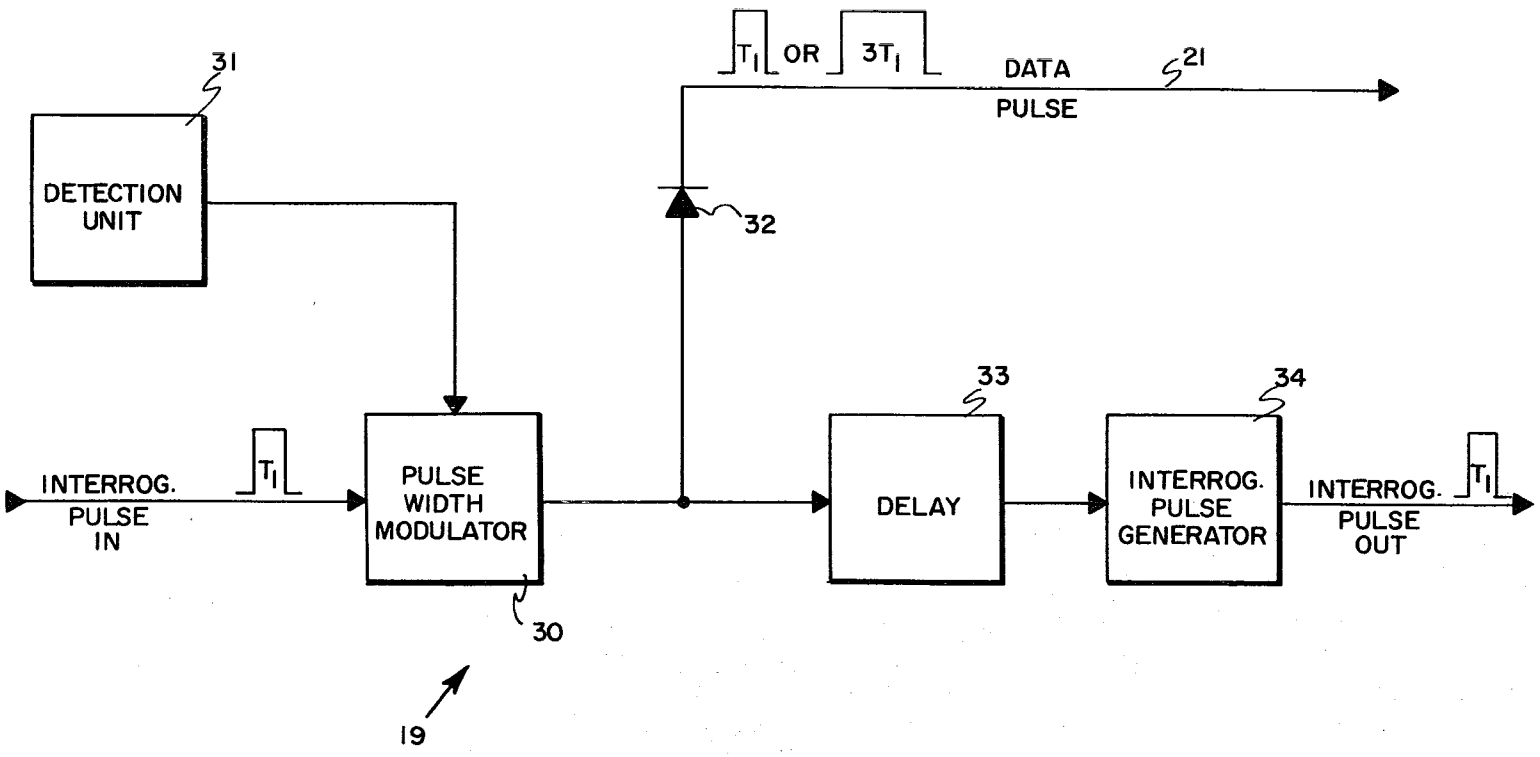
FIG. 2 is a block diagram of a detector station utilized in the system of this invention.

Each detector station 19, is shown in block form in FIG. 2. As shown, the interrogation pulse (indicated to have a width T1) from the scanning panel or preceding detector station (except for the last detector station) is coupled to a conventional pulse width modulator 30 which receives a second input from detection unit 31. Detection unit 31 may be, for example, an ionization smoke detector, a photo-electric smoke detector, a heat detector, a thermostat, a pull station, or any contact closure or open, all of which are well known in the art.

Modulator 30 provides a pulse output signal, the width of which is dependent upon whether the output is received from detection unit 31 indicative of a fire sensed by the detecting unit. It has been found that an output pulse from modulator 30 having about three to five times the width of a normal output pulse (i.e., when no output is received from detection unit 31) is satisfactory for reliable system performance in indicating an alarm condition (relative pulse widths may be varied, however, as necessary, so long as a clear distinction of pulse widths exist at the modulator output). As indicated in FIG. 2, the output pulse width with no sensed fire can have a width T1 and the output pulse indicative of a sensed fire can have a pulse width of 3T1.

This output pulse from modulator 30 is coupled through diode 32 to provide a data pulse on electrical lead 21, and is also coupled through delay 33 to interrogation pulse generator 34 where a new pulse is generated and coupled from the detector unit to the next succeeding unit except for the last detector station which need not include delay 33 and interrogation pulse generator 34.

Each interrogation pulse generated by each succeeding detector unit generates an interrogation pulse that is timewise delayed with respect to the interrogation pulse received by the detector station. For this purpose, interrogation pulse generator 23 is triggered by the end of the interrogation pulse received by the detector as well as being delayed by delay 33.

Thus, in normal operation, each detector station receives an interrogation pulse with pulse width equal to T1. It then generates an output data pulse with a pulse width equal to T1 or 3T1. If no fire condition has been detected, the output data pulse width equals T1. If a fire condition has been detected, the output data pulse width is equal to 3T1. In addition, at the end of the output data pulse, a new interrogation output pulse, having a width equal to T1, is generated in interrogation pulse generator 34 to trigger the next detector station in line.

The timewise spacing between interrogation pulses thus causes a train of timewise spaced data pulses to be produced on lead 21 since each detector station is triggered with an interrogation pulse from a preceding detector station (or from the scanning panel if the detector station is first in line).

The spacing between pulses is the same regardless of whether a wide pulse indicative of a fire is present, since the next interrogation pulse will be delayed until this pulse is completed (i.e., the next interrogation pulse will not be generated until a later time). This is no problem, however, since there is sufficient capacity in the system for the complete cycle prior to the starting to a new sensing cycle and, if all units have not been scanned prior to the end of the cycle, the new cycle will be delayed until all units have been scanned (since the new cycle is not commenced until all units have responded as verified by a counter). The number of pulses in the pulse train will depend, of course, on the number of detector stations utilized.

Figure 3:
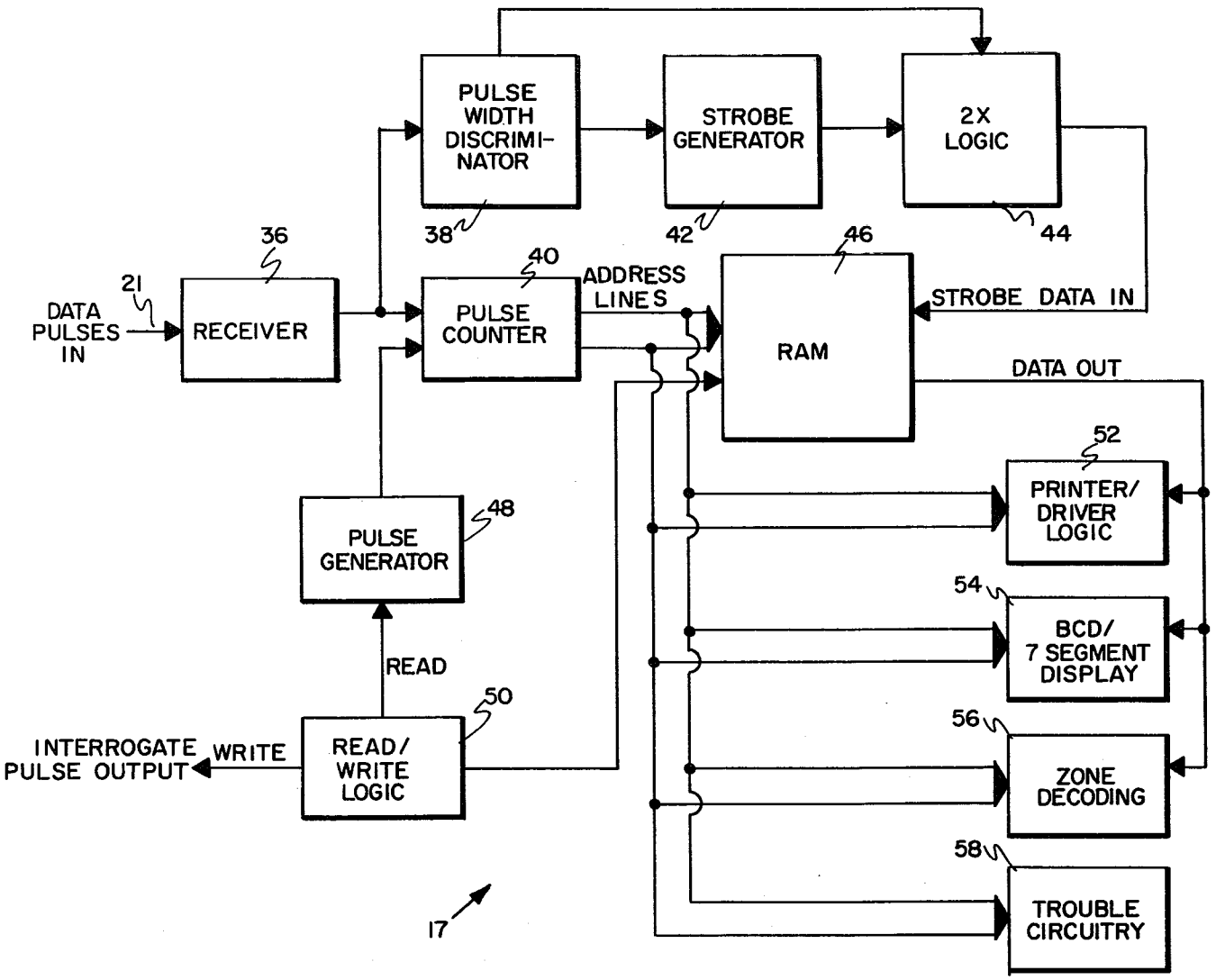
FIG. 3 is a block diagram of the scanning panel utilized in the system of this invention.

Scanning panel 17 is shown in block form in FIG. 3. As shown, receiver 36 receives the input data pulses on lead 21 from detector stations 19. Receiver 36 acts as a pulse shaping circuit and data pulses are coupled therefrom to pulse width discriminator 38 and pulse counter 40.

Pulse width discriminator 38 provides an output signal when a data pulse is received indicative of a sensed fire (i.e., a pulse width having a width of, for example, 3T1). At this time, discriminator 38 provides an output pulse which is coupled to strobe generator 42 and to 2× logic circuit 44. The output from the 2× logic circuit 44 enables the strobe data to input to random access memory (RAM) 46. In addition, the output from pulse counter 40 is coupled by address lines to the random access memory.

Pulse generator 48 provides a second input to pulse counter 40, and pulse generator 48 receives a READ input from READ/WRITE logic circuitry 50, which circuitry also outputs an interrogate output pulse in the WRITE mode. READ/WRITE logic circuitry 50 also provides an output to random access memory 46. If a fire is present, random access memory 46 provides data output in the READ mode to printer/driver logic circuitry 52, BCD/7 segment display circuitry 54, and zone decoding circuitry 56, all of which also receive an output from pulse counter 40 as does trouble circuitry 58.

2× logic circuit 44 is a verifying circuit used to prevent false fire indications from activating the alarm circuit. As shown, 2× logic 44 also receives an input from pulse width discriminator 38. Unless a fire indicating pulse occurs at the same count in two successive cycles, 2× logic 44 is precluded from coupling the strobe output from the strobe generator to the random access memory and hence to BCD/7 segment display 54. This circuitry thus protects the system from random false alarms.

Figure 4A:
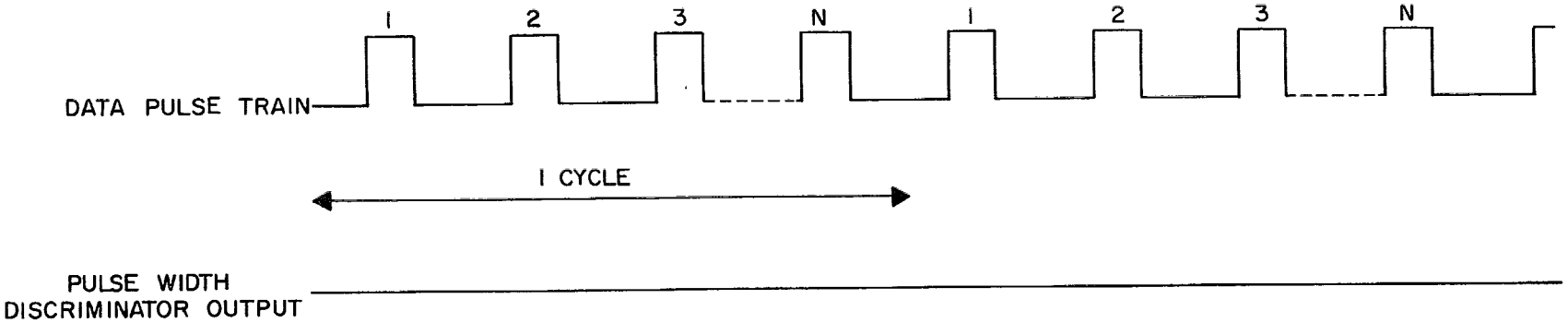
FIGS. 4(*a*) and 4(*b*) are waveforms to illustrate operation of the invention.
Figure 4B:
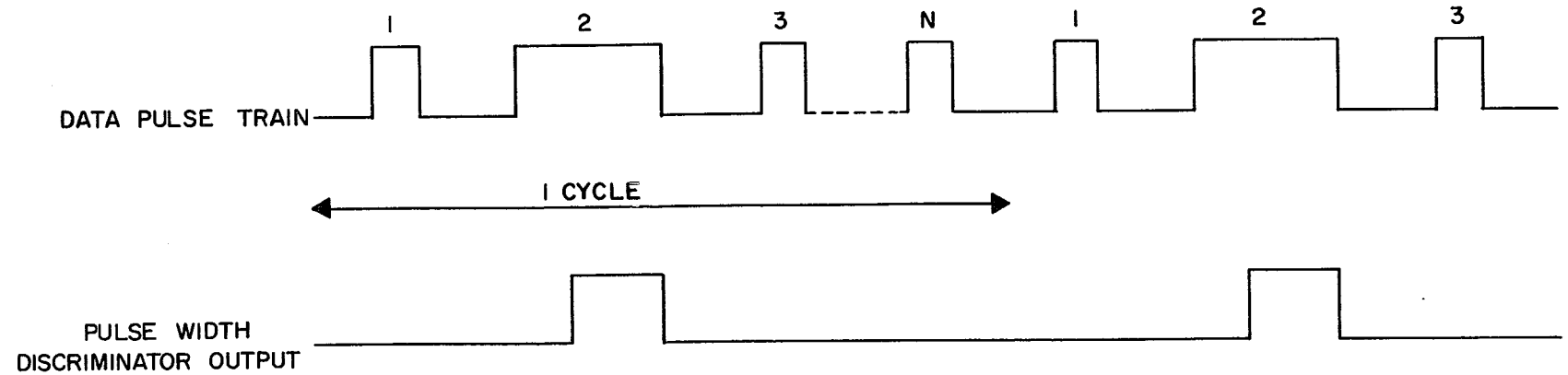

As shown by way of example in FIG. 4(*a*), each detector station is interrogated once each cycle (which occurs approximately once each second) and if no fire is sensed at any detector station, then pulse width discriminator 38 is precluded from providing a pulse output and this prevents triggering of strobe generator 42. Thus, no alarm indicative of a fire is indicated.

But, as again shown by way of example in FIG. 4(*b*), if a fire is sensed at detector station 2, then pulse width discriminator 38 provides a pulse commencing at the time of normal termination of the data pulse if no alarm is sensed, with the width of the pulse generated by pulse width discriminator 38 being timewise depending upon the width of the alarm pulse indication from detector station 2. The pulse thus generated by pulse width discriminator 38 triggers strobe generator 42 which produces a strobe pulse output which is coupled through 2× logic 44 to RAM 46. In the READ mode, the output from RAM 46 causes activation of the printer/-driver logic circuitry 52, and is coupled to BCD/7 segment drive display 54 to cause the sensed fire location to be displayed, as for example, a 2 would be displayed if the fire is indicated from the second detector station as shown by way of example in FIG. 4(*b*).

In addition, the output from RAM 46 (as well as the output from pulse counter 40) are also coupled to zone decoding circuitry 56 to cause a selected zone fire circuit to be energized, as well as any other alarm circuitry connected therewith. When detector station 2 senses a fire, for example, zone 1 (which might include detector stations 1 through 10, for example) will be activated to sound an alarm for the zone.

By providing zone logic, this allows any group of detectors to be confined between two selected boundaries (i.e., an upper limit and a lower limit). The limits are programmable with switches. Any number of detector stations may be programmed within any zone, and any detector station sensing a fire condition within the boundaries set by the limit switches for that zone will generate an alarm condition for that zone. The associate zone remains latched until reset.

The output from pulse counter 40 is also coupled to trouble circuitry 58 which circuit provides a trouble indicating output to trouble circuit 64 to provide an output that is indicative of sensed trouble in the device. The trouble circuitry constantly monitors for shorts or opens on the loop connected with the scanning panel and the detector stations. Once each cycle (after all data pulses are received at the scanning panel from the detector stations), a trouble check pulse is generated and coupled to trouble circuit 58 where the highest pulse number is compared with a pulse preprogrammed equal to N (from the maximum count at maximum counting unit 63). If the numbers match, no output is produced by trouble comparator 58, and a trouble-free indication is provided. If the numbers do not coincide, however, this indicates a short or open in the loop and the trouble circuit 58 is caused to operate an alarm signal. Display 54 will also show the number of the last pulse received and the number will remain displayed until the problem is cleared and the system returns to normal operation.

Thus, as can be appreciated from the foregoing, each detector station is in series with a subsequent station, and all of the stations are connected into one complete series loop. Each of the detector stations includes a detection unit which can be, for example, a smoke detector. An example of such a smoke detector is an ionization smoke detector which is well known. The system of this invention is not, however, meant to be restricted to use with smoke detectors and can be used with any monitoring system (including systems other than fire alarm systems) in which a plurality of events or happenings can be monitored by switch closure, and such switch closure shall be in terms of a function which goes from normally open to closed or normally closed to open. For purposes of this illustration, however, smoke detectors will be utilized as the detection unit providing the monitored switch closure.

In operation, the first detector station on the line, as brought out hereinabove, has four input wires and four output wires, all of which are connected to the input side of the next detector station in the loop. This same wiring arrangement continues until the loop is completed at the last detector station (the number of detector stations that can be included is any number between 1 and 999 in the embodiment of the invention as described herein although the circuitry could be adapted to utilize still more detector stations if needed or desired).

Figure 5:
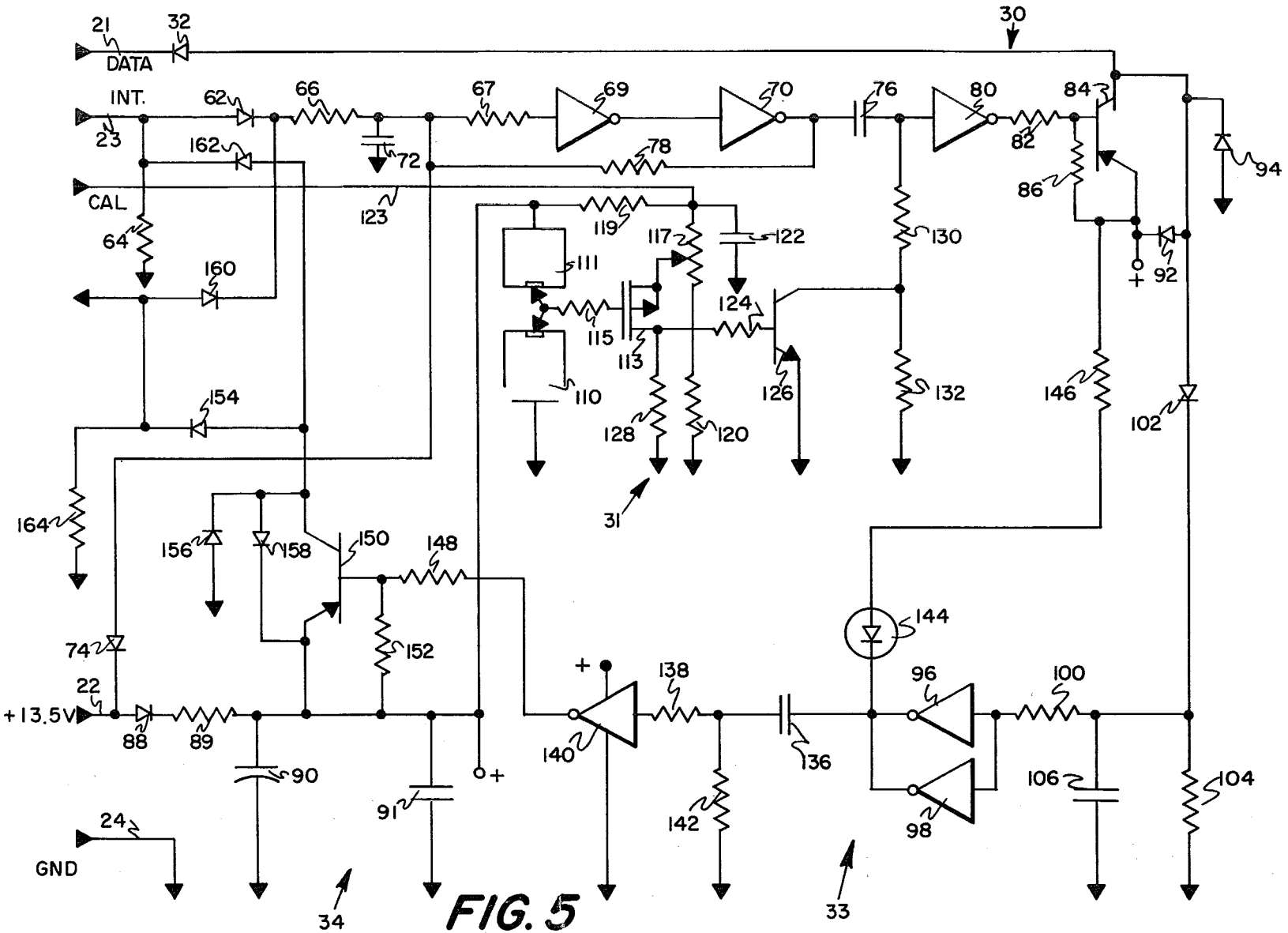
FIG. 5 is an electrical schematic of a detector station for sensing a fire that may be utilized as the detector stations in the system of this invention.
Figure 6A:
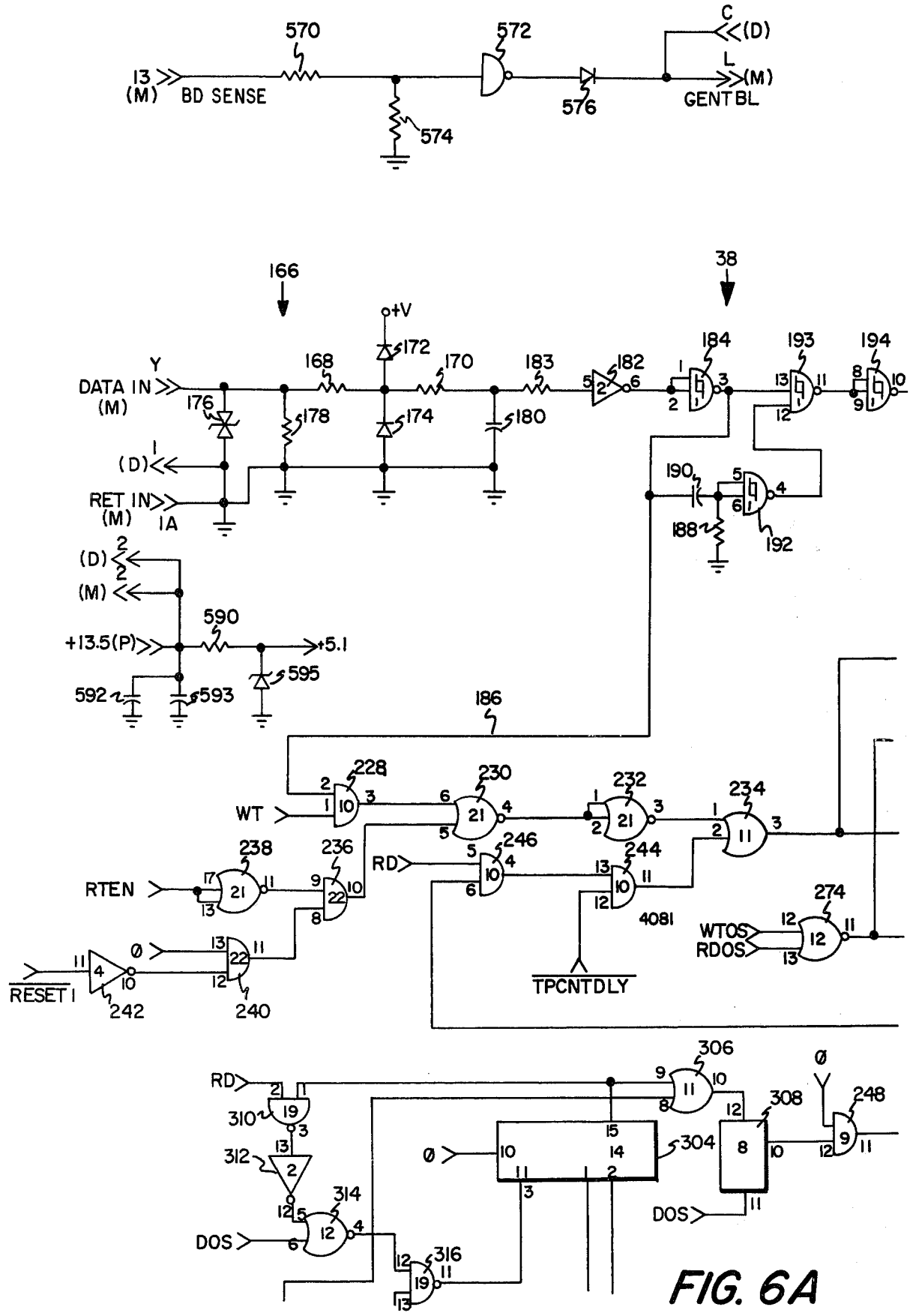
FIGS. 6(*a*) through 6(*d*), taken together, form an electrical schematic diagram of the logic card of the control, or scanning, panel utilized in the control system of this invention.
Figure 6B:
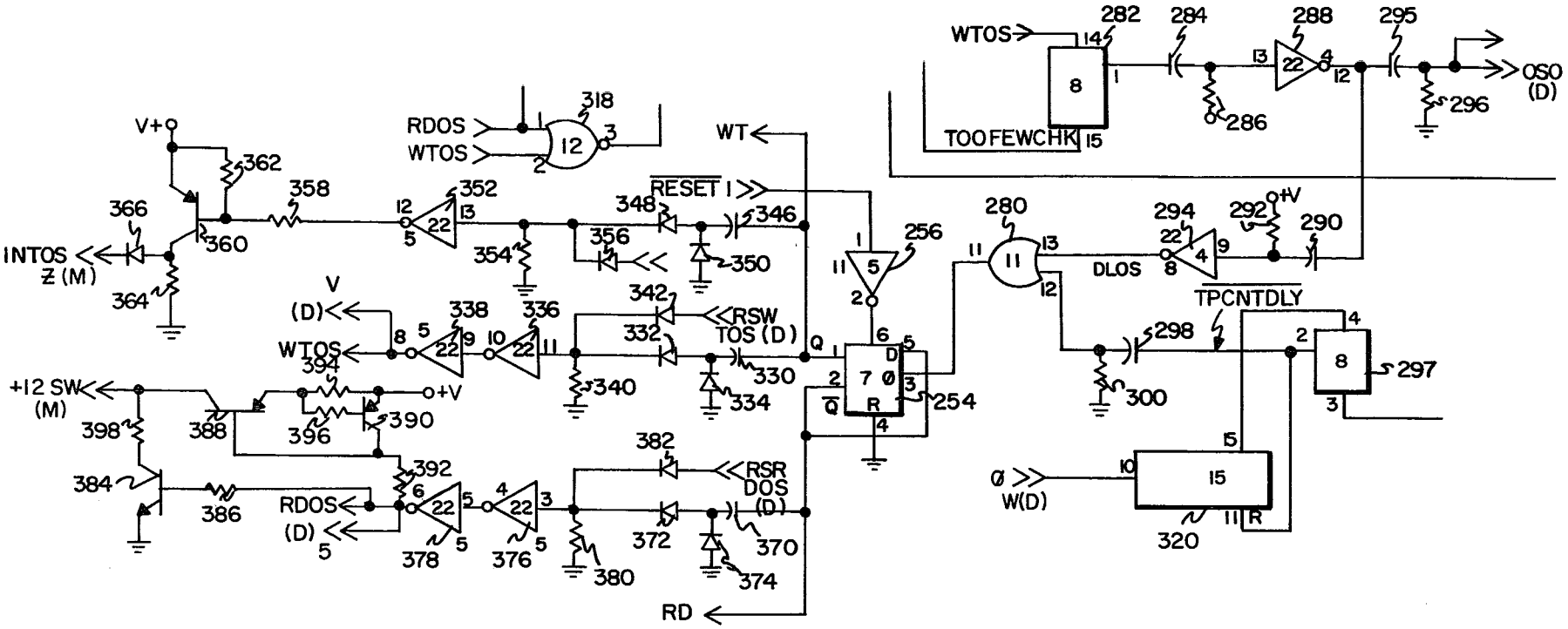
Figure 6C:
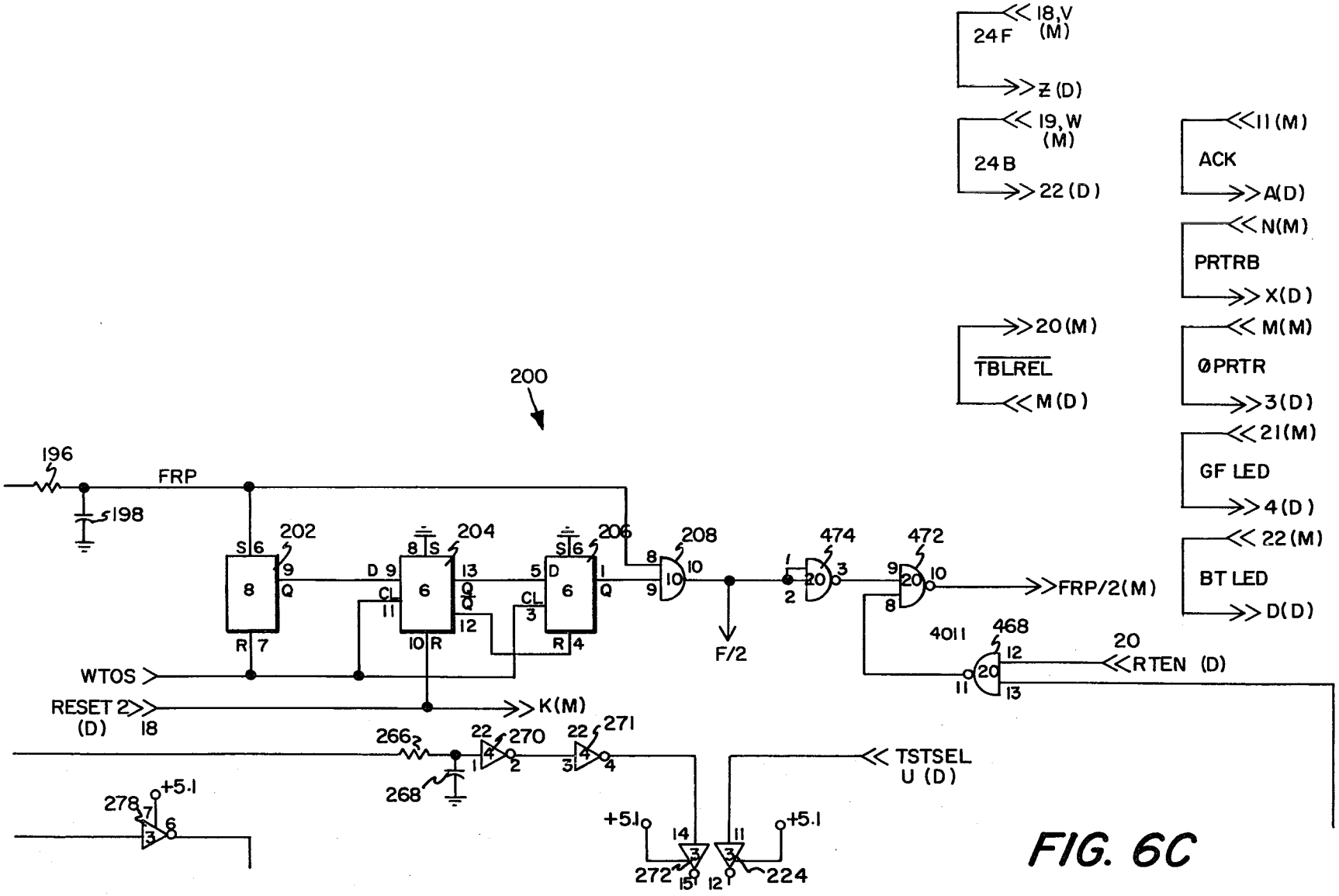
Figure 6D:
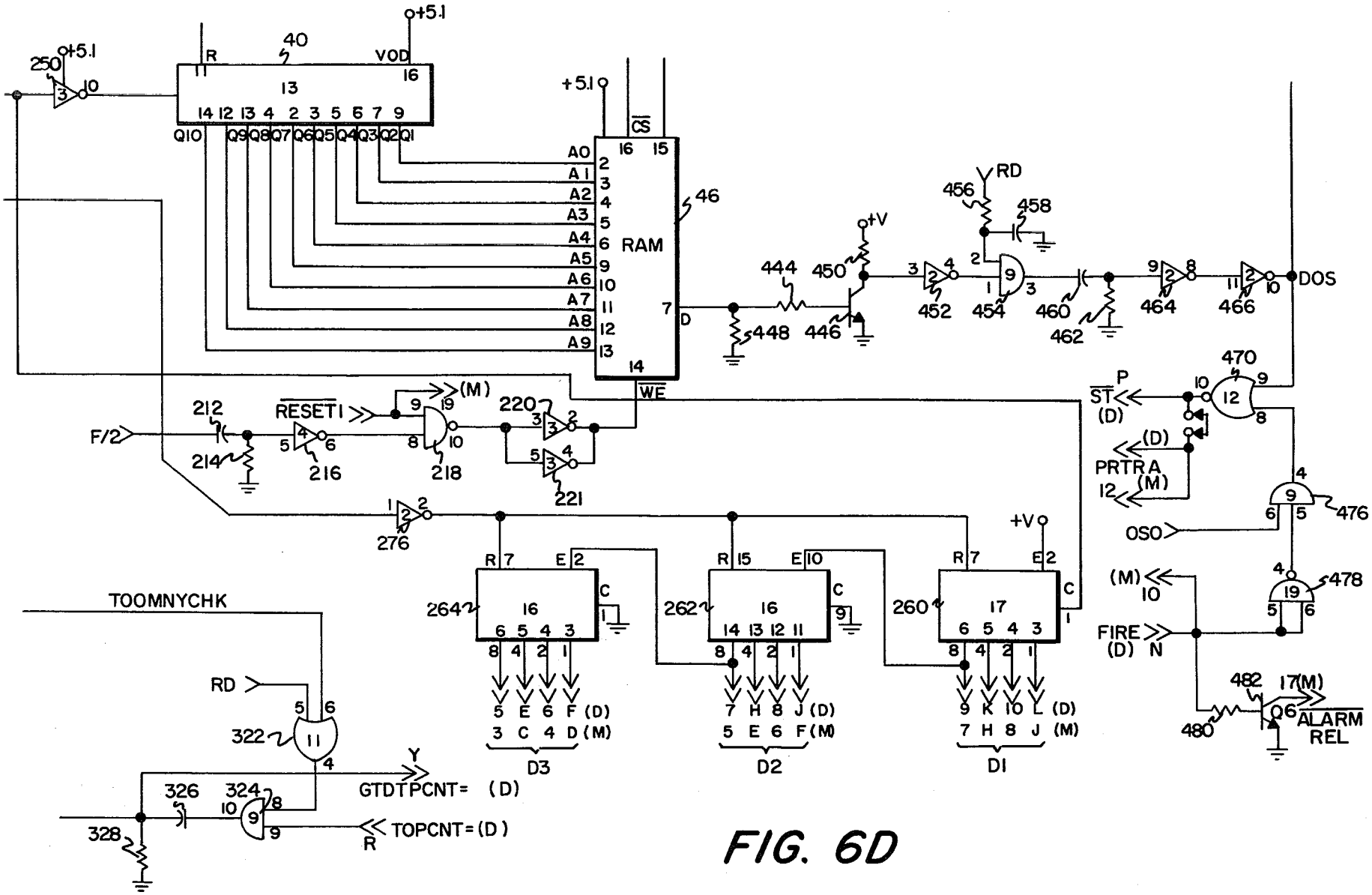

A detector station utilizing a smoke detector, is shown in detail in FIG. 5. As shown, the four lead wires (21–24) to the detector provide power (V+ which is +13.5 volts), a signal and power return (ground), incoming interrogate pulses, and outgoing data pulses.

The interrogate pulse on lead 23 is coupled through diode 62 (all of which in the detector stations may be 1N4148 unless otherwise indicated), which diode has a resistor 64 (2.2K) to ground at one side and series connected resistors 66 (100K) and 67 (1 M) at the other side connected with series connected inverter gates 69 and 70 (all of which in the detector stations may be 4069 unless otherwise indicated). The junction of resistors 66 and 67 is connected through capacitor 72 (all of which in the detector station may be 1000PF unless otherwise indicated) to ground, and to the V+ power supply through diode 74.

The output of inverter 70 is connected to one side of capacitor 76, as is the V+ power supply through diode 74 and resistor 78 (1 M). The other side of capacitor 76 is connected to inverter 80 the output of which is coupled through resistor 82 (3.3K) to the base of transistor 84 (2907) of pulse width modulator 30.

The base of transistor 84 is connected with the emitter through resistor 86 (3.3K) and the emitter is connected with the V+ power supply (+13.5 volts) through diode 88 (1N4001) and resistor 89 (10), with the junction between the emitter and resistor having parallel connected capacitors 90 (33 μFd) and 91 (1000PF) to ground connected therewith. The collector of transistor 84 provides the data output pulse from the detector station on lead 21 through diode 32, with the collector also being connected to the V+ power supply through diode 92, with ground through diode 94, and with inverter gates 96 and 98 through resistor 100 (1 M) and diode 102, the junction of resistor 100 and diode 102 being connected to ground through resistor 104 (1 M) and capacitor 106.

Pulse width modulator 30 also receives the output from detector unit 31. As shown in FIG. 5, detector unit 31 is illustrated as an ionization smoke detector and includes a pair of chambers 110 and 111 connected in series between ground and the V+ power supply with the junction between chambers 110 and 111 being connected with FET 113 (823) through resistor 115 (10 M).

FET 113 is connected at one side to variable potentiometer 117 (0 to 1 M), which potentiometer is connected in series with resistors 119 (10K) and 120 (2.2 M) between the V+ power supply and ground with the junction of resistors 117 and 119 having a bypass capacitor 122 to ground and a lead 123 for calibration purposes. The other side of FET 113 is connected through resistor 124 (1 M) to the base of transistor 126 (930) and with ground through resistor 128 (10 M).

The collector of transistor 126 is connected to the input side of inverter 80 of pulse width modulator 30 through resistor 130 (470K) and with ground through resistor 132 (2.2 M).

The time constants of pulse width modulator 30 are such that unless the detector unit 31 provides a wide alarm indicating pulse (of 3T1), the output pulse is a nominal 0.5 msec which is coupled through diode 32. If detection unit 31 should, however, provide a wide width signal indicative of a condition such as a fire, then the output is a nominal 1.5 msec (or greater widths) and this is gated onto the data line 21 through diode 32.

The trailing edge of the data pulse is used to generate the interrogate output pulse to the next detector. For generation of the interrogate output pulse, the output from pulse width modulator 30 is coupled to delay circuitry 33 by being coupled from inverters 96 and 98 through series connected capacitor 136 and resistor 138 (1 M) to inverter 140, with the junction of capacitor 136 and resistor 138 having a resistor 142 (330K) to ground and the junction of gates 96–98 and capacitor 136 being connected to one side of an LED 144 the other side of which is connected to the V+ power supply through resistor 146 (2.2K).

The output from inverter 140 is coupled through resistor 148 (3.3K) to the base of transistor 150 (2907) of interrogation pulse generator 34. The base of transistor 150 is connected with the V+ power supply through resistor 152 (3.3K) and the output from the collector is coupled from the unit as the interrogation pulse out through diode 154, with the collector also having a diode 156 to ground and being connected to the emitter through diode 158. The interrogation input pulse and pulse output junctions may be interchangeable through the use of diodes 160 and 162 (comparable to diodes 62 and 154) and resistor 164 (comparable to resistor 64).

Each detector station thus receives an interrogate pulse which preferably has the characteristics of being a nominal 500 μsec in pulse width. After the interrogation pulse is received at the detector station, the pulse goes through the internal logic where it is modulated into a pulse which is outputted on the data line. If the detector is not in the alarm condition, the station will output the pulse on the data line with a pulse width equal to a nominal 500 μsec.

If the detection unit has sensed a fire, however, the detector changes the characteristics of the output by increasing the pulse width from a nominal 500 μsec to a value about three times higher, i.e., to a width of about 1.5 μsec. This allows transferring of information back to the control panel by a minimal use of wires and the panel (due to its internal circuitry) monitors each received pulse to determine if a pulse with the greater pulse width has occurred and responsive thereto, indicates an alarm situation (as opposed to the normal pulse width that is indicative of a non-alarm condition).

Each detector station also generates an interrogate out pulse to the next detector station. The interrogate out pulse is once again a pulse having a nominal 500 μsec pulse width.

The criticality of the amplitude parameters is minimal as the system is looking for digital data in terms of pulse width and is not sensitive to variation in pulse amplitude, so therefore the levels on the lower and upper limits of the pulses are not critical.

The second detector station in the line then receives its interrogate pulse, which has been generated by the first detector station and coupled therefrom as an interrogate output pulse. The second detector station then processes the incoming interrogation signal in the same manner as did the first station, except that the second detector station responds to an interrogate input pulse which has been generated by the first detector station (whereas the first detector has responded to an interrogate pulse that has been generated from the control panel).

Each succeeding detector station then provides an interrogation pulse in the same manner to each succeeding detector station in the loop with each providing an output pulse that is either indicative of an alarm condition or no alarm condition, and each detector in the line puts out an interrogate output pulse to the following detector. The last detector on the loop need not provide an output interrogation pulse, but can produce such a pulse, if convenient, but such pulse is not utilized.

The second and each succeeding detector station will respond timewise later than did the first and/or preceding detector station so that a train of pulses (each timewise separated) is received at the control panel on lead 21 as data pulses.

As can be appreciated from the foregoing, the detector stations are completely interchangeable at any point on the loop because any detector station can be put at any point in the loop since the detectors and the logic signals in and out of the detector stations are essentially bilateral (non-directional, which is to say that the power-in and ground leads are interchangeable as are the interrogate and data leads).

In addition, the system of this invention does not require the use of an end of line device for supervision, because in the panel the supervision is done electronically by virtue of its logic (in typical applications in fire alarms the points on the line, the smoke detectors, etc., must be supervised in an analog fashion by monitoring the line with a quiescent DC current, which is termed supervision current, and this requires the use of an end of line device which is typically a resistor or some other component such as a diode).

FIGS. 6 through 11 illustrate in detail the scanning panel 17. As indicated in FIG. 6(*a*), the data pulses received from detector station 19 are coupled through a mother board to analog filter 166 (3 db at 3 KHz) of receiver 36. Analog filter 166 has a roll-off of approximately, 3 db per decade, and therefore will filter out any frequency component above 3 KHz, but will allow data pulses to come through because the data rate, the nominal clock rate, is 2 KHz.

As shown, the data pulses are coupled through series connected resistors 168 (10K) and 170 (22K), with the connection of resistors 168 and 170 having diodes 172 and 174 connecting the junction to the V+ power supply and ground, respectively. In addition, resistor 168 is connected to one side of Zener diode 176 and resistor 178 (1K) each of which is connected at the other side to ground, while resistor 170 is connected at opposite sides with ground through capacitor 180 (0.001 μFd) and to inverter 182 (4069) through resistor 183 (117).

The data input pulse train (which is comprised of a pulse train with as many pulses in the pulse train as there are detector stations) passes through the filter and is inputted into an integrated circuit, and more particularly, is coupled to IC2 pin 5 (i.e., at the input of inverter 182). The output from inverter 182 is coupled through Schmidt inverter 184 (4093) with the signal output therefrom being on pin 3. The output at pin 3, which is the restored data train from the data, is then inputted by pulse width discriminator 38 and ultimately to pulse counter 40 from lead 186.

Pulse width discriminator 38 is comprised of a network made up of resistor 188 (2 M) and capacitor 190 (0.001 μFd) connected with inverters 192, 193 and 194. The values of resistor 188 and capacitor 190 are chosen to form a window whose lower end is nominally at 1 msec so that discriminator 38 will provide an output pulse through the IC at pin 10 (i.e., at the output of inverter 194), only if the pulse width is wider than the 1 msec window. If a pulse is received having a pulse duration greater than 1 msec, there will be a pulse generated at the discriminator output (at pin 10) (which pulse is designated FRP for fire pulse). This FRP output signal is then coupled to the 2× logic circuitry 44 as a strobe pulse to WRITE a high logic level 1 into the random access memory (RAM) 46.

The output of inverter 194 (pin 10) is coupled to resistor 196 (100) (FIG. 6(*c*)) which resistor has capacitor 198 (0.1 μFd) to ground connected at one side thereof, with the FRP signal being then coupled to digital filter 200 (and more particularly to the set input of flip-flop 202 (4043)), the Q output of which is coupled to the D input of flip-flop 204 (4013),with the Q output of flip-flop 204 being coupled to the D input of flip-flop 206 (4013), the Q output of which is coupled to NAND gate 208 (4081) as one input, the other input to which is the FRP output signal.

The output from AND gate 208 (F/2) is coupled through capacitor 212 (1000PF) (FIG. 6(*d*)), which capacitor has resistor 214 (10K) connected at one side to ground, and inverter 216 to NOR gate 218 (4011) as one input thereto, which gate receives a second input of $\overline{\text{RESET 1}}$. The output of gate 218 is coupled through parallel connected inverters 220 and 221 (4048) to pin 14 of RAM 46 to provide the strobe pulse to the RAM.

Memory 46 is cleared, during reset, by using the input pulses to WRITE in a logic zero into all locations in the memory. This is achieved by programming a logic low into the data input pin 15 of the RAM through inverter 224 (4049) (FIG. 6(*c*)).

The reshaped data pulses on lead 186 are coupled to the pulse counting circuitry 40 through gating circuitry which includes, more particularly, AND gate 228 (4081) (FIG. 6(*a*)), which gate receives a second input of WT. Since WT is high (during the WRITE cycle), an output is coupled from NAND gate 228 through NOR gates 230 and 232 (4001) to OR gate 234 (4071). Nor gate 230 receives a second input from NAND gate 236, which gate receives an input from NOR gate 238 and a second input from NAND gate 240, one input to which is the $\overline{\text{RESET 1}}$ input coupled through inverter 242 (4069). OR gate 234 receives a second input from AND gate 244 (4081) receiving one input from AND gate 246 (4081) which, in turn, receives one input from AND gate 248 connected with pulse generator 48.

The output from OR gate 234 is coupled through inverter 250 (FIG. 6(*d*)) (where the signal is inverted and translated into a +5 volt level as is required for interfacing with RAM 46) to RAM address binary circuit, or pulse counter 40 (4040). Counter 40 is used as the RAM address counter, and counts up starting at a base count of zero and continuing therefrom to a top number N which is equal to the total number of pulses received. Counter 40 is a straight binary counter and outputs binary counts to the address inputs of the RAM, counting through all the RAM addresses that are to be used.

In this system, the top number will be N and every time this is reached, an address data will be strobed into the RAM as a zero by virtue of the fact that the input line at pin 15 has been held low during this time. In addition, during this time the WRITE enable line, which is the line actually used to write data into the memory, will be held low during the entire duration of the reset signal. This is accomplished by using the logic utilizing $\overline{\text{RESET 1}}$ which is coupled as an input to inverter 218 (IC19) to cause a high output therefrom which is inverted by the inverters 220 and 221 and coupled into the WRITE enable input of RAM 46 to hold the WRITE enable low for the entire reset cycle so that as the address counter counts through all the counts of the addresses, all data will be written into memory as a low level.

As brought out hereinabove, data is coupled through NAND gate 228 (FIG. 6(*a*)) which is enabled during the entire WRITE cycle. The WRITE cycle is generated initially during reset by READ/WRITE flip-flop 254 (IC7) (a 4013D type flip-flop) (FIG. 6(b)) the Q output of which provides the WT (WRITE) output.

During the entire course of operation, the system is in either the RWAD mode or the WRITE mode. The system will always be in the WRITE mode while it is receiving data back from the data line, will always switch to the READ mode after it has completed the WRITE mode, and will read through the memory once each scan cycle to verify whether it has picked up any new alarm conditions in the memory.

The system is forced into the WRITE mode during reset by virtue of coupling the $\overline{\text{RESET 1}}$ signal into the READ/WRITE flip-flop 254 at pin 6 through inverter 256 (40106).

Pin 6 of READ/WRITE flip-flop 254 will thus be high during the reset time (which is six seconds) and with a high input on pin 6 (set input), flip-flop 254 will respond with a high logic signal on pin 1 (the Q output and a low logic signal on pin 2 the Q output) which defines the WRITE mode.

The output from OR gate 234 (IC11, pin 3) (FIG. 6(*a*)) provides an input to three places, including through inverter 250 (FIG. 6(*d*)) to counter 40 to provide a clock input thereto.

The data pulses are also coupled from OR gate 234 to integrated circuit 260 (IC17, pin 1) (4518) (FIG. 6(*d*)). This circuit is the data BCD counter and counts up in BCD fashion to output BCD counts on its data lines through a three stage counter which is made up of integrated circuit 260 and integrated circuits 262 and 264 (IC16-two parts, both 4518), which are effectively two counters stacked in series and used as a triple counter. When integrated circuit 260 has reached a count of 9 and recounts to a 0, it will output a counting pulse into the second digit counter 262 which therefore counts by tens. In like manner, counter 262 outputs a counter pulse to counter 264 when it counts to a 0. The first counter 260 is therefore counting units, the second counter 262 is counting tens of counts, and the third counter 264 is counting hundreds of counts. The data pulses received at the counters are thus counted up in BCD form during the reset cycle.

The data pulses from OR gate 234 are also coupled to the chip select input of RAM 46, after having been delayed a nominal 15 nanoseconds by virtue of a delay circuit made up of resistor 266 (10 K) (FIG. 6(*c*)), capacitor 268 (47PF), and inverters 270 and 271 (40106) and inverter 272, the latter of which is a translating inverter (which inverter is used since the RAM utilized in this system is a 6508, which is a 1024/1 memory RAM which requires a 5 volt DL logic signal so all logic signals into the RAM, including the address logic, chip select logic, and the WRITE enable data are translated down from the 12 volt CMOS signals to 5 volt compatible signals). The 15 nanosecond delay into the chip select pin of the RAM is to allow a compatibility for usage between several kinds of RAMs, if desired.

Resetting of counters 260, 262 and 264 (FIG. 6(*d*)) is provided by RDOS and WTOS inputs generated at the beginning of each mode during initialization of normal operation and coupled through NOR gate 274 (4001) (FIG. 6(*a*)) and inverter 276 (4069) (FIG. 6(*d*)). In addition, pulse counter 40 is reset by RDOS and WTOS inputs through inverter 278 (4059) (FIG. 6(*c*)).

The $\phi$ input to READ/WRITE flip-flop 254 (FIG. 6(*b*)) is coupled from OR gate 280 (4071) which receives one input from counter 282 (4043) through a one shot circuit made up of capacitor 284 (0.1 $\mu$Fd), resistor 286 (4.7 M), inverter 288, capacitor 290 (1000PF), resistor 292 (10K) and inverter 294 (40106). In addition, an OSO output is provided at the junction of diode 288 and capacitor 290 through capacitor 295 (1000 PF) having resistor 296 (10K) to ground connected thereto. The second input to OR gate 280 is from counter 297 (4043) through capacitor 298 (1000PF) having resistor 300 (10K) to ground connected thereto.

Counter 282 is connected with counter 304 (4020) (FIG. 6(*a*)), which counter provides an output to OR gate 306 (4071) the output of which is coupled to counter 308 (4043) which provides an output to AND gate 248. Counter 304 also provides an output to NAND gate 310 (4011) the output of which is coupled through inverter 312 (4069), NOR gate 314 (4001) and NAND gate 316 (4011), which gate receives a second input from NOR gate 318 (4001) (FIG. 6(*b*)), to provide a reset input to counter 304.

Counter 297 (FIG. 6(*b*)) is connected with counter 320 (4020) and with counter 304 through OR gate 322 (4071) (FIG. 6(*d*)), and to OR gate 324 (4081), and capacitor 326 (1000PF) having resistor 328 (10K) to ground connected thereto.

The $\overline{Q}$ output of READ/WRITE flip-flop 254 (FIG. 6(*b*)) provides the write (WT) output as well as the WTOS output through series connected capacitor 330 (1000PF) and diode 332 (the junction of which is connected to ground through diode 334) and inverters 336 and 338 (40106) (the junction of gate 336 and diode 332 has a resistor 340 to ground connected thereat and a RSINTOS input coupled through diode 342 thereat).

In addition, the Q output of READ/WRITE flip-flop 254 is coupled through capacitor 346 (470PF) and diode 348, the junction of which has a diode 350 to ground connected thereat, and inverter 352 (40106). The junction of diode 348 and inverter 352 has a resistor 354 (470K) to ground connected thereat and a RSINTOS input is coupled thereto through diode 356. The output from inverter 352 is coupled through resistor 358 (22K) to the base of transistor 360 (2907), which base is connected to the +V power supply through resistor 362 (22K) and the collector of which is connected to ground through resistor 364 (1K). An INTOS output is coupled from the collector through diode 366.

The Q output from READ/WRITE flip-flop 254 provides the read (RD) output and the RDOS output through capacitor 370 (0.01 $\mu$Fd) and diode 372 the junction of which has a diode 374 to ground connected thereat, and inverters 376 and 378 (40106). The junction of inverter 376 and diode 372 has a resistor 380 (47K) connected to ground thereat and a RSRDOS input is coupled thereto through diode 382.

The RDOS output is also coupled to the base of transistor 384 (2N2222) through resistor 386 (10K) and the base of transistor 388 (2N2907) and the collector of transistor 390 (2N2907) through resistor 392 (10K). The emitter of transistor 388 is connected to the emitter and base of transistor 390 through resistor 394 (4.7) and 396 (1K), respectively, while the collector of transistor 384 is connected to the collector of transistor 388 (from which an output is taken) through resistor 398 (10).

After generation of one cycle of input data, which is used to clear the memory and to count-up, the system is initialized which includes initializaing the internal counters. Several other functions have also been activated. One such function is called the one shot zero circuit. One shot zero is a circuit that is utilized during every WRITE cycle to check the lines to see if top count has been achieved.

During each WRITE cycle after completion of a READ cycle, counter 304 (FIG. 6(*a*)) is enabled by applying WTOS thereto on the reset line, when switching to the WRITE cycle, and starts counting up from a count of zero, and will try to count up to a three second mark. Counter 282 (IC8) (FIG. 6(*b*)) is connected with counter 304, and if counter 304 is able to count to the three second mark, then a one shot zero is generated by counter 282 (a latch circuit) receiving an output from counter 304. When the device is switched to the WRITE cycle, the output on pin 1 of counter 282 is forced low, but if counter 304 is allowed to time out, counter 282 will switch back high after the three seconds and this high going output is coupled through the differentiator to inverter 288 (IC4, pin 13) where the input is used to generate one shot zero (OSO), which is a single shot pulse with a nominal pulse width of approximately 50 msec and a positive going pulse DLOS (the pulse width on the timing signals is not critical).

There are only two ways in which READ/WRITE flip-flop 254 is changed in state. One of these is by an input clocked through OR gate 280 and inverter 294 (DLOS) or through capacitor 298 and resistor 300 ($\overline{\text{TPCNTDLY}}$).

One shot zero is always generated if counter 304 is allowed to count out, because every time the circuitry is switched to the WRITE cycle, two things happen. The logic is trying to generate one shot zero by counting up through counter 304 and utilizing this pulse to generate a signal to strobe data into the display, which signal will then be attempting to display a count which is indicative of a trouble condition. But a display indicative of trouble will be allowed only in one shot zero is allowed to be generated by virtue of the fact that the proper number of counts have not been received back along the data line.

The second thing that is happening is that the data pulses which are coming back are being compared in the top count logic to see if top count is achieved. If top count is satisfied, and if it is satisfied prior to the three seconds which are required for one shot zero to be generated, the conditions will be satisfied allowing the logic to be switched back into the READ mode. This will be indicative of having satisfactorily achieved one WRITE cycle. When this occurs, the system is then switched back to the READ mode, and goes back and reads through memory to see if during the WRITE cycle any fires have been sensed by the detecting stations.

The top count check is determinative of whether or not the proper top count has been achieved during the WRITE cycle. The top count logic is logic which is utilized to provide a digital method of supervision of the line to verify that all counts have been properly received, that is, that a return pulse has been received from every detecting station in the loop. The system is tailored to have a matching condition between the total number of detecting stations and program switches within the logic which are used to generate the top count equal signal. The program switches (i.e., top count switches) include three digital switches 402 (units), 403 (tens), and 404 (hundreds). The number that is programmed into the three top count switches must match the number of pulses that is received back on the data lines when one pulse is received from each detecting station for eacy cycle.

Figure 7A:
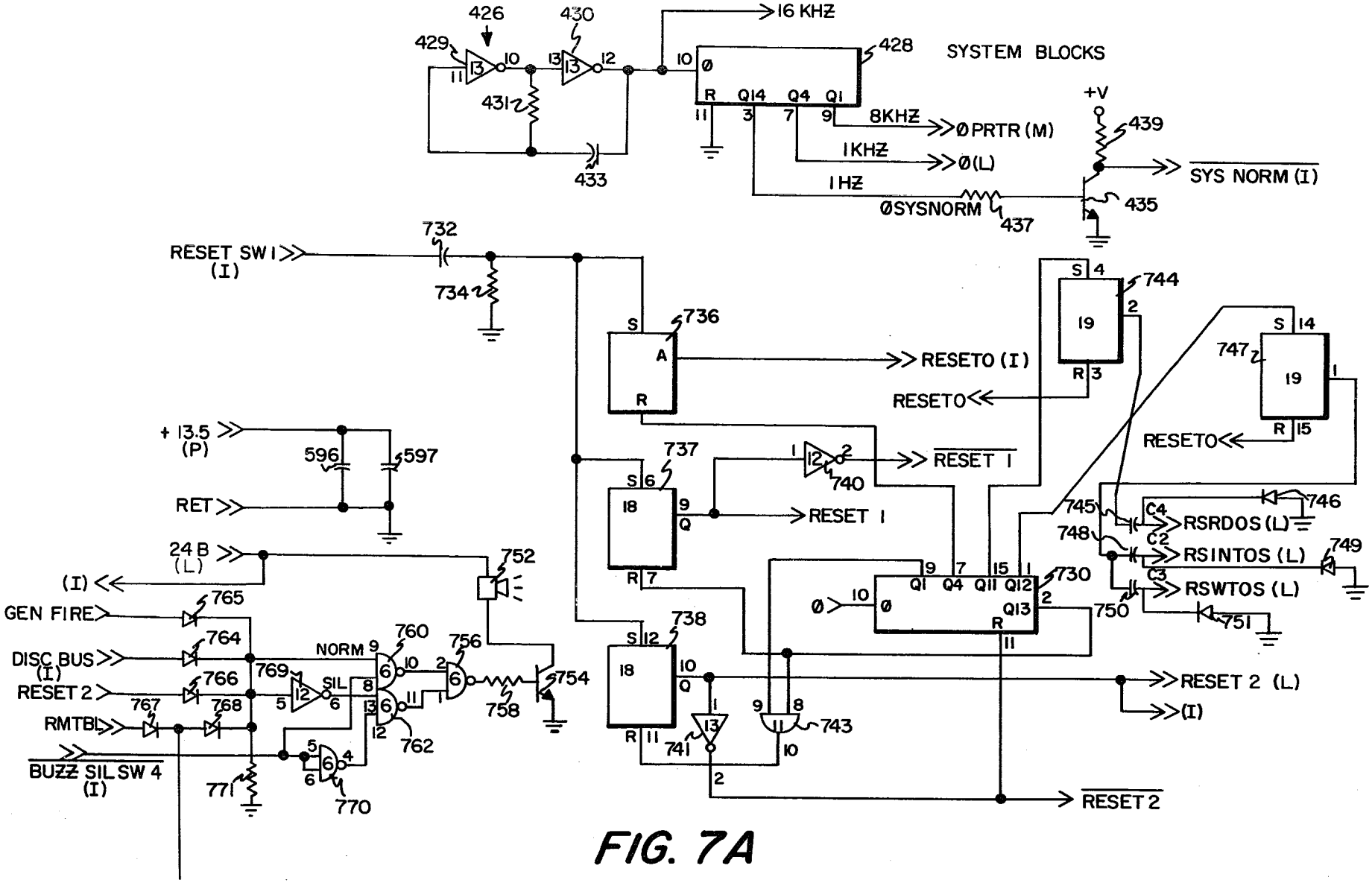
FIGS. 7(*a*) through 7(*c*), taken together, form an electrical schematic diagram of the display driver card of the control panel utilized in this invention.
Figure 7B:
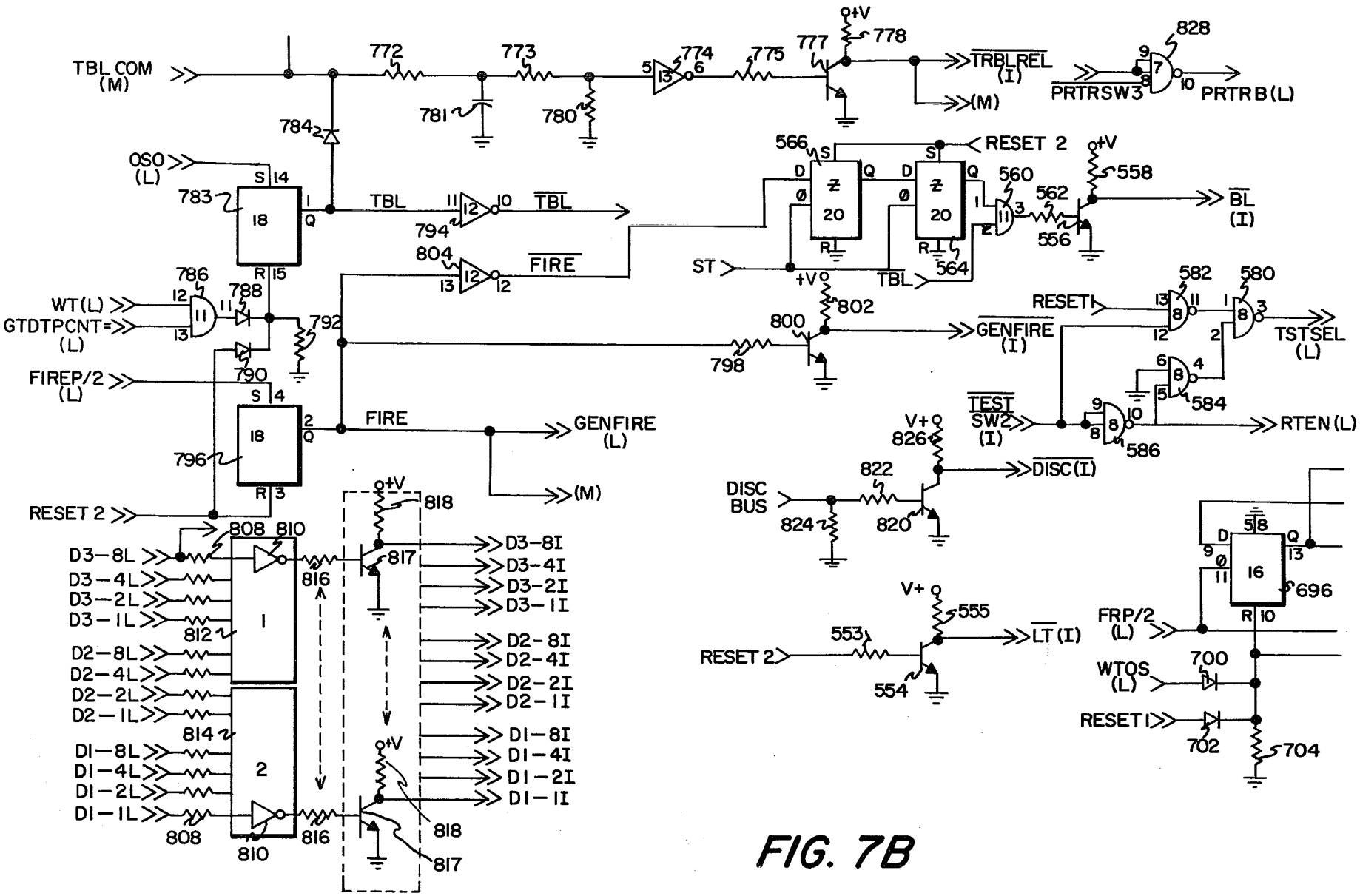
Figure 7C:
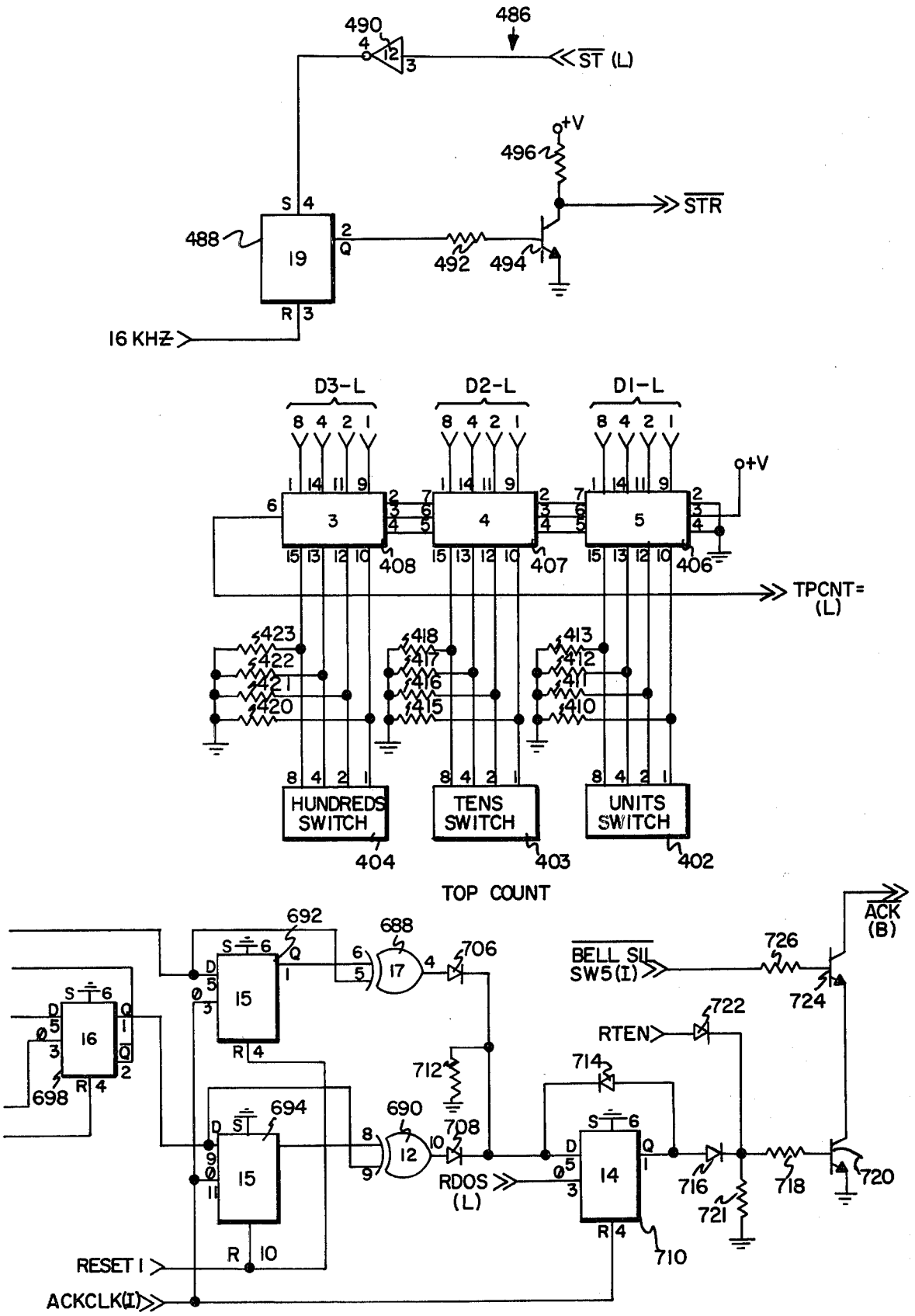

For example, if the system has 669 detecting stations in the loop, the top count switches must be set to 669. These switches then output an 8421 code which will be the BCD equivalent of the 669 decimal number programmed in, and this BCD equivalent is then inputted into comparators 406, 407 and 408 (4063s) where the unit's digit, the ten's digit, and the hundred's digit are compared, respectively, with an input from the data lines, which input is coupled from counters 260, 262 and 264 (designated D1, D2 and D3, respectively) (FIG. 6(*d*)). As shown in FIG. 7(*c*), each switch connection with each comparator includes a resistor (designated 410, 411, 412 and 413 for the unit switch; 415, 416, 417 and 418 for the ten's switch; and 420, 421, 422 and 423 for the hundred's switch—typically 1 M). These D lines are BCD counts which are the BCD equivalent in parallel of what the serial pulses were as received from the detecting station.

So in the example, as the pulses come in, they are counted in BCD fashion from a count of 1 to 669. If 669 is reached, which is equal to the number preprogrammed into top count switches 402–404, a high WRITE level is generated at pin 6 of hundred's comparator 408. This signal top count equal (TPCNT) is utilized in several places.

The top count equal signal (TPCNT) is coupled as one input to AND gate 324 (FIG. 6(*d*)) and the output signal from this gate is differentiated by capacitor 326 (1000PF) and resistor 328 (10K) to generate a differential spike type pulse which is used as a reset pulse to reset counter 297 (FIG. 6(*b*)), which counter provides an output to cause READ/WRITE flip-flop 254 to switch to the READ mode.

The switch to READ, however, is delayed by top count delay circuit 320. This delay is necessary to reduce power consumption that would occur if the system is allowed to free run, automatically all the time, back and forth between the READ and WRITE modes.

By introduction of a delay, which is approximately one-half second, the duty cycle of the system is reduced and the pulses that would be coming back on the line, instead of free running at a very high rate, will always have a delay of approximately one-half second. This one-half second is added during both the READ mode and the WRITE mode, so that the total delay of the data is approximately one second.

After the top count delay circuit 320 has timed out, which is approximately one-half second, its output is high going, and is coupled through the differentiating circuit to OR gate 280. OR gate 280 allows two signals to come through, one of which is from the top count circuitry and the other of which is from the one shot zero circuitry.

Turning now to the display of data, display occurs when the READ/WRITE flip-flop 254 is in the READ mode with RD high and WT low. At this time, RDOS is generated and the +12SW output from transistor 388 is pulsed low. RDOS resets the address counter 40 as well as counter 260, 262 and 264 (FIG. 6(*d*)) to a count of zero.

Data is available to the D lines, and an internal clock 426 (producing $\phi$) (FIG. 7(*a*)) is used to count the location of the internal pulses. Clock 426 includes a counter 428 (4020) having connected thereto, at pin 10, a pair of series connected inverters 429 and 430, the junction of which is connected with resistor 431 (47K) the other end of which resistor is connected with pin 10 through capacitor 433 (1000PF). A 16 KHz output is provided at pin 10, an 8 KHz output ($\phi$PRTR) is provided at Q1 (pin 9), a 1 KHz output ($\phi$) is provided at Q4 (pin 7), and a 1 Hz output ($\phi$SYSNORM) is provided at Q14 (pin 3), which output is inverted to $\overline{\text{SYSNORM}}$ by transistor 435 (2N2222) having a resistor 437 (10K) connected with the base and the collector connected to V+ power supply through resistor 439 (10K).

The clock pulses (at 1 KHz) are coupled through AND gate 248 to AND gate 246 (pin 6) as long as gate 248 receives a high logic level or the second input (pin 12). This input at pin 12 will continually be high until a number is to be displayed, at which time the input drops low for approximately one second to cut off the internal clock and to retain the display which will then be available on the three digit display for approximately one second.

With pin 12 of gate 248 high, the internal clock is free running, and gated through gate 248 to gate 246 (pin 6). The pulses are gated through gate 246 so long as pin 5 is high (the RD signal applied is high when in the READ mode). Therefore, the internal clock pulses will be coupled to gate 244 and be coupled therethrough, after the delay imposed by the top count delay circuit. The pulses are thus coupled through OR gate 234 to the BCD counters (260–264) (FIG. 6(*d*)), to the RAM address counter 40, and to the clip selector pin on RAM 46 (after going through the 50 msec delay).

Internal pulses are now counted. As the count continues, the RAM address counter 40 (FIG. 6(*d*)) outputs a binary count into the RAM address lines, and RAm 46 outputs data onto its data output line (pin 7), at every address into which a logic "1" was writted during the WRITE mode.

The data outputted by RAM 46 at pin 7 is coupled through resistor 444 (10K) to transistor 446 (1N2222) with pin 7 also having a resistor 448 (100K) to ground connected thereto. The output is taken from the collector of transistor 446, which collector is connected through a resistor 450 (1K) to the V+ power supply, and coupled through inverter 452 (4069) to AND gate 454 (4081), which gate receives an RD input through resistor 456 (1 M) with the junction being connected with ground through capacitor 458 (47PF). The output from gate 454 is coupled through capacitor 460 (1000PF), having resistor 462 (1 M) to ground connected thereto, and through series connected inverters 464 and 466 (4063) to NAND gate 468 (4011) (FIG. 6(*c*)) and NOR gate 470 (4001) (FIG. 6(*d*)).

The output of NAND gate 468 (FIG. 6(*c*)) is coupled as one input to NAND gate 472 (4011) the other input of which is coupled from NAND gate 474 (4011), which gate receives its input from AND gate 208. Gate 472 provides the FRP/2 output.

NOR gate 470 (FIG. 6(*d*)) receives a second input from AND gate 476 (4081), which gate receives the OSO input and the output from NAND gate 478 (4011). NAND gate 478 receives its input from the FIRE input, which input is also coupled through resistor 480 (10K) to the base of transistor 482 the collector of which provides an output to the $\overline{\text{ALARM RELAY}}$. Thus, if both alarm and trouble should appear simultaneously, alarm will have priority since a fire input will override the OSO input into AND gate 476.

By way of example, assume that there is an alarm at detector station 369. When the count reaches 369, the binary equivalent of 369 on the RAM causes a high logic level output on pin 7 of RAM 46. This high going transition is coupled through the translating driver 446 to translate the output back to the 12 volt logic level necessary to be compatible with the rest of the CMOS circuitry system. All the logic used is CMOS so that minimum power consumption is utilized. This signal is then coupled through the inverter 452 to gate 454 (IC9, pin 1) which gate is enabled by the READ signal. This high going transition is coupled through the differentiating network to generate a strobe pulse which is coupled through NOR gate 470. The low to high pulse generated on pin 9 of NOR gate 470 provides a high to low transition, this providing the strobe pulse ($\overline{\text{ST}}$) at the output of NOR gate 470, which pulse is then used to strobe data.

The strobe pulse is coupled to pulse stretching network 486 where the pulse is coupled to integrated circuit 488 (4043) (pin 4) through inverter 490 to delay the pulses by 40 msec. The pulses are outputted through resistor 492 (10K) and the transistor 494, the collector of which transistor is connected with the +V power supply through resistor 496 (10K). This output is termed $\overline{\text{STR}}$ and is essentially just the strobe signal.

Figure 9A:
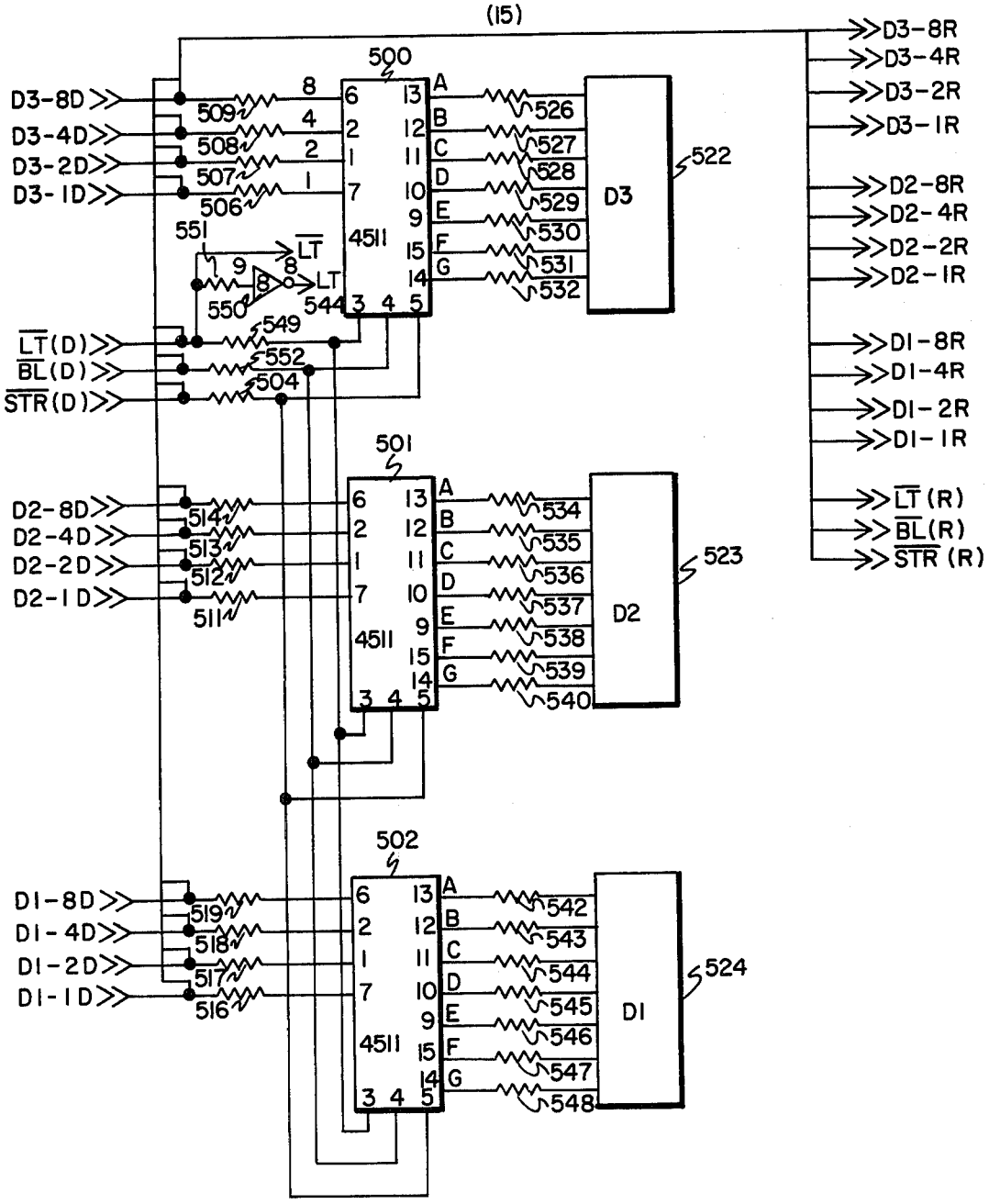
FIGS. 9(*a*) through 9(*c*), taken together, form an electrical schematic diagram of the indicator card of the control system utilized in this invention.
Figure 9B:
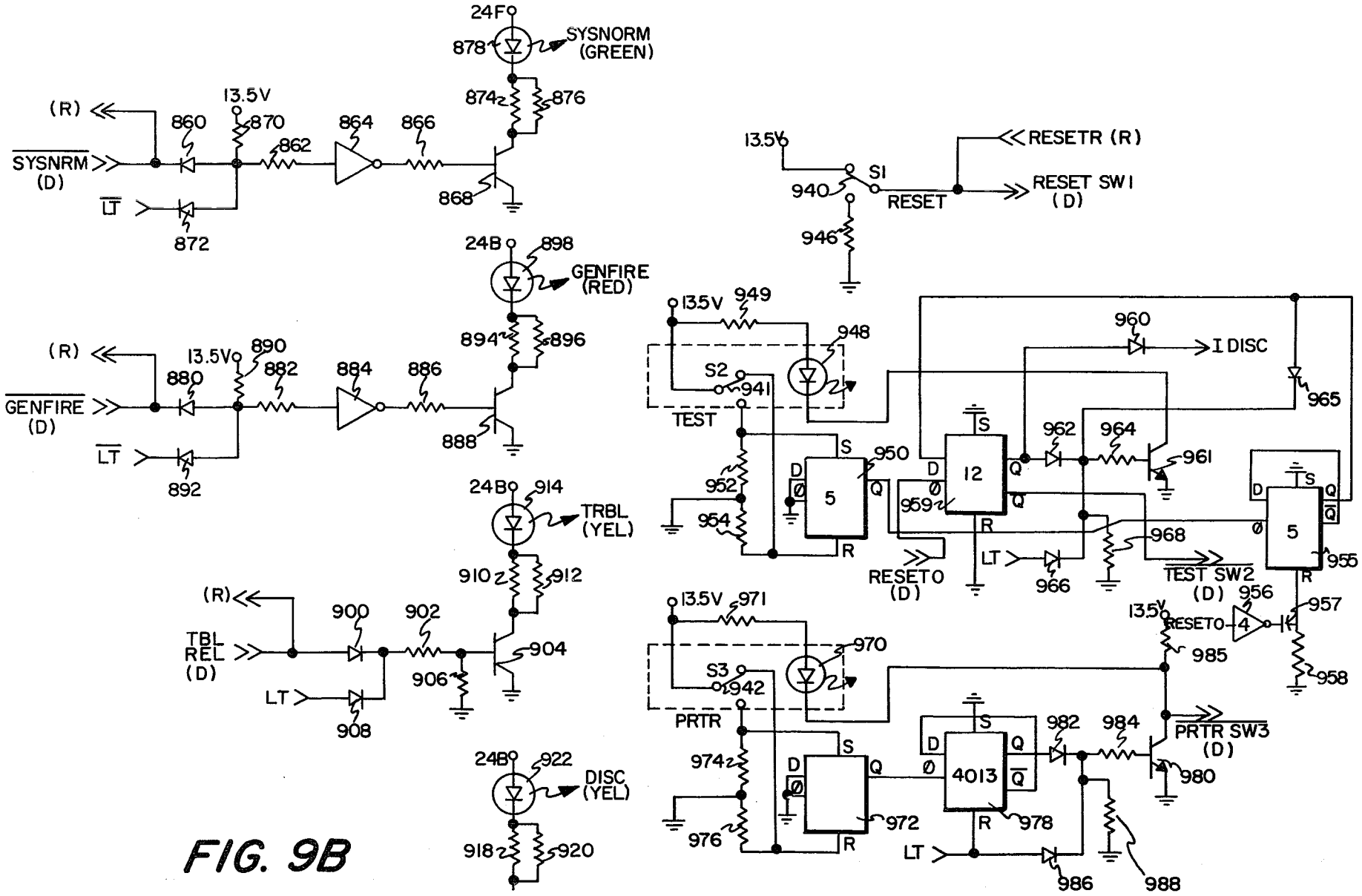
Figure 9C:
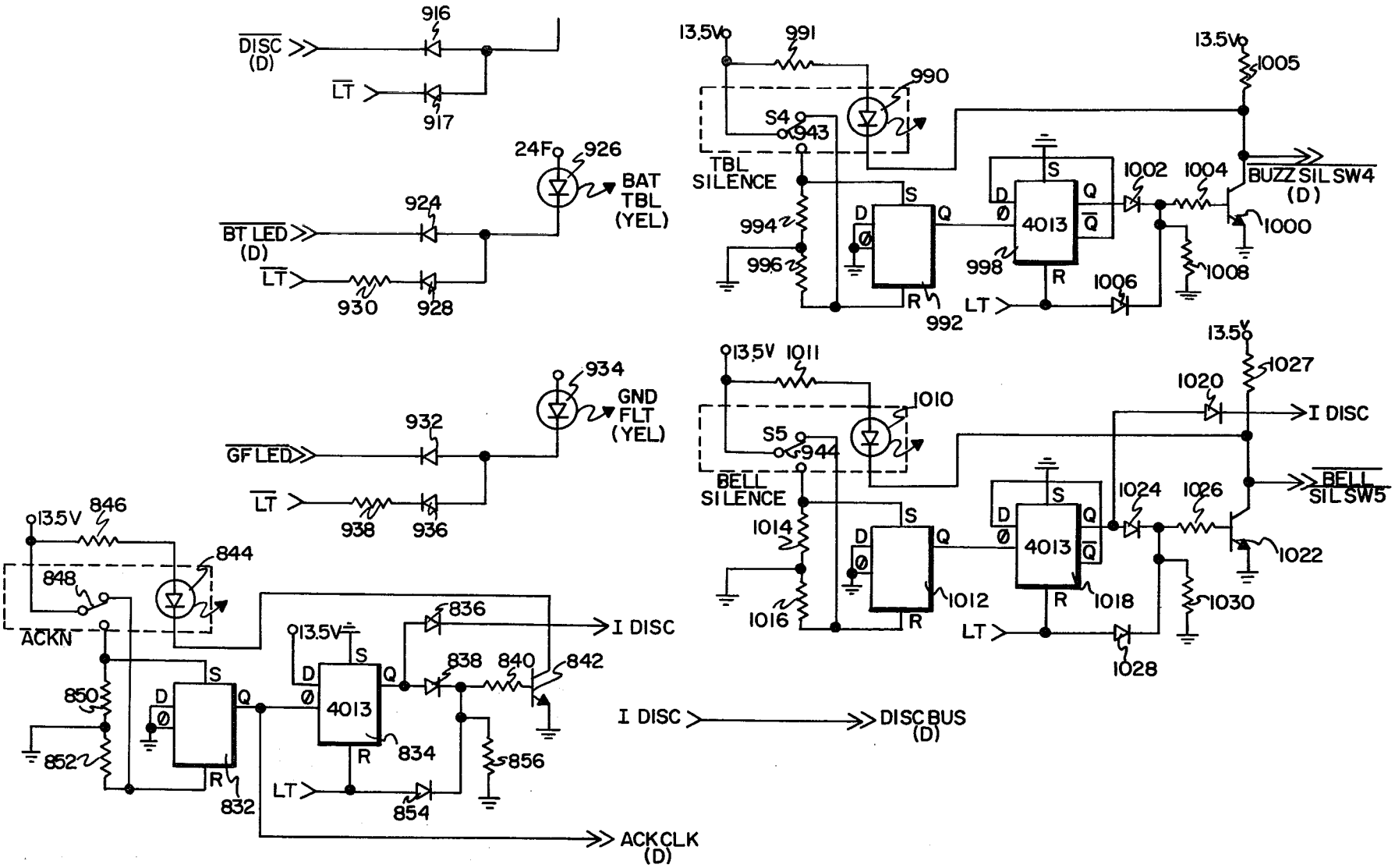

The signal $\overline{\text{STR}}$ is coupled to counters 500, 501 and 502 (4511s) (FIG. 9(*a*)) (at pin 5 of each) through resistor 504 (10K). Counters 500–502 have a count of 369 impressed thereon (where it is assumed by way of example that a fire indication is received from detecting station 369), which count is in BCD form on the data lines (generated by counters 260–264), with the inputs being coupled to counters 500, 501 and 502 through resistors 506–509, 511–514, and 516–519, respectively (each resistor being of a typical value of 1M).

Counters 500–502 receive the strobe pulse and strobe the number that it has in it, in the example, a 369. The counters 500–502 are decoding chips that take BCD and convert over to the seven segment driving compatible signals (designated A through G signals). The count of 369 is strobed to drive the three displays 524, 523 and 522 (seven segment displays—DL 850), respectively, so that the displays indicate a 369. The displays are driven through resistors 526–523, 534–540 and 542–548. Counters 500–502 also receive an input $\overline{\text{LT}}$ on pin 3 through resistor 549 (which input is inverted by inverter 550) connected through resistor 551 to provide an LT output), and an input $\overline{\text{BL}}$ on pin 4 through resistor 552. $\overline{\text{LT}}$ is generated originally by the reset signal and is utilized as a LAMP test signal wherein all the lights are turned on during the reset period. The LAMP test signal coupled into counters 500–502 drives the output lines high and turns on all segments of the seven segment display. $\overline{\text{BL}}$ is a blanking signal available for use to be able to blank out the displays with the signal being generated by a driver.

$\overline{\text{LT}}$ is generated by coupling the RESET signal through resistor 553 (10K) (FIG. 7(*b*)) to transistor 554 (2N2222) the collector of which is connected to the +V power supply through resistor 555 (10K) and provides the $\overline{\text{LT}}$ output. $\overline{\text{BL}}$ is generated at the collector of transistor 556 (2N2222) which collector is connected to the +V power supply through resistor 558 (10K). The base of transistor 556 receives the output from AND gate 560 through resistor 562 (10K), which gate receives $\overline{\text{TBL}}$ as an input and the Q output of flip-flop 564 (4013) at its other input. Flip-flop 564 has the D input connected to the Q output of flip-flop 566 (4013) which is set by the RESET input thereto.

Thus, the exact location of a detecting station sensing an alarm condition has been displayed (369 as in the example utilized). The 369 display is held for one second until the output on pin 10 of counter 308 (IC8) (FIG. 6(*a*)) goes low where it stays until the counter for the internal logic (i.e., counter 304) counts up to a one second count and enables the output of counter 308 to go high which allows the system to continue clocking pulses.

In only one alarm was sensed by one detecting station, the clock continues to count upwardly until top count is reached. The top count logic will generate the top count equal signal and the system is switched back to the WRITE mode (after the top count delay). With only one alarm condition sensed during the WRITE mode, one scan cycle is READ with information sensed correctly indicating one alarm condition.

If additional alarms are sensed at other detecting stations during a WRITE scan (for example, at detecting station 469), a second alarm condition is also sensed. During the WRITE mode, the 469 would also be strobed into memory along with the 369 (as used herein by way of example). Then in the READ mode, the count of 369 is first displayed for one second as above described, and the counter clock again starts to count up (at its high speed of approximately 1 KHz) until the 469 count is reached. At this point, the circuitry will operate the same as for the first alarm station sensed, but will cause a display of 469 for one second. After this period, the count will resume until top count is reached or until another alarm condition is encountered.

While a WRITE cycle can be terminated by the occurrence of either DLOS or STDRWCLK, a READ cycle can be terminated only by occurrence of STDRWCLK since in the RD mode, TOPCNT=will always transition high at AND gate 324 (FIG. 6(*d*)) as it is generated by $\phi$ and will always thereafter achieve a match (in the WT mode, STDRWCLK is generated only if TOPCNT=was achieved and if it was high when TOOMNYCHK went high through OR gate 322 and AND gate 324). To summarize the system as explained hereinabove, upon completion of the first scan cycle, the system is ready to start checking real data for alarm conditions. With the system in the WRITE mode, reshaped data is available at the output of NOR gate 184 (FIG. 6(*a*)). This data is coupled through the pulse width discriminator 38 which has a time constant of 1 msec. If the data pulse is longer than 1 msec, the FRP output signal (indicative of an alarm condition) will be generated with a pulse width equal to the difference between the 1 msec and the negative transition of the data pulse. Any pulse less than lmsec will not generate FRP.

If FRP is generated, then some detecting station has detected an alarm condition. If the digital filter was verified, then DFVER is high at the second input of AND gate 208 (FIG. 6(*c*)) and this allows the FRP signal to be gated therethrough and coupled (as F/2) to pin 14 of RAM 46 (FIG. 6(*d*)) (assuming that DFVER is high and adapter X in is alarm condition) where the leading edge of the pulse will generate a $\overline{WE}$ input to the RAM.

Since the system is in the WRITE mode, a logic 1 is written into the memory at the address corresponding to the number of X in the data train (369 as assumed to be X in the example above). This is made possible since the address counter 40 then holds the binary count corresponding to X and since the RAM data input (pin 15) is always high after completion of reset (which is six seconds) with TSTSEL being quiescent low.

After the "1" is written into the memory at location X, the RAM addresses are incremented upward as the data train continues to advance the address counter 40. If no more alarm conditions are detected, then no more F/2s are generated by the pulse width discriminator 38 and no further "1" is written in the memory. The logic then switches to the READ mode, when top count is reached (i.e., when the count reaches the number equal to the total number of detecting stations in the loop).

In the READ mode, address counter 40 again addresses the RAM starting at address 0. When the count reaches X, the RAM data out (at pin 7) goes high, and the "1" is translated, inverted, and reinverted, and then gated through AND gate 454 to generate DOS at the output of inverter 466 (FIG. 6(*d*)). DOS is then utilized to generate FRP/2 at the output of NAND gate 472 (FIG. 6(*c*)) and to generate $\overline{ST}$ at the output of NOR gate 470 (FIG. 6(*d*)). $\overline{ST}$ is used to strobe X into the display (522–524) (FIG. 9(*a*)) for display as a decimal number.

The DOS output also resets counter 308 (FIG. 6(*a*)) to produce a low output at pin 10 ($\overline{\phi CUTOFF}$) and resets counter 304 through gates 314 and 316. $\overline{\phi CUTOFF}$ is driven back high after 1.5 seconds when counter 304 transitions high at pin 15. This allows the display of the detecting station in alarm for 1.5 seconds. With multiple alarms, each will be displayed 1.5 seconds until all have been displayed.

Referring to the 2× logic (which may be viewed as a digital filter 200), this adds additional filtering and immunity against noise susceptibility and stray erroneous inputs to the RAM. RESET 2 initially sets a high output at $\overline{Q}$ of counter 204 (FIG. 6(*c*)) and a low Q output. This holds the reset (pin 4) of counter 206 high to hold DFVER low and this prevents the first FRP signal appearing at AND gate 208 from passing through the gate as the F/2 output signal.

Since each WTOS resets counter 202 and clocks counters 204 and 206, DFVER will always have a 0 clocked from counter 206 by WTOS prior to generation of the first FRP.

The first FRP sets the Q output (pin 9) of counter 202 to a "1". The immediately following WTOS clocks the "1" from counter 202 to counter 204 and resets counter 202 and counter 204 to produce a 0 at pins 9 and 12, respectively, and clocks a 0 to the Q output (pin 1) of counter 206. If during this same WT cycle another FRP occurs, the Q output (pin 9) of counter 202 will again be set high and the following WTOS will again clock a 0 to the reset input (pin 4) of counter 206 to allow a "1" at the D input (pin 5) of counter 205 to clock through to the Q output (pin 1) and be coupled to AND gate 208. DFVER is now high and as subsequent FRPs appear they will gate through AND gate 208 and generate F/2 at the output thereof.

If FRP is not again generated in the next consecutive cycle, the second WTOS will clock the 0 through to the reset input (pin 4) of counter 206 and F/2 will not be generated. Thus, the digital filter (i.e., 2× logic) requires FRP for two consecutive cycles to generate F/2 to thereby provide additional immunity to spurious signals.

In the example given, the first alarm condition was due to a sensed alarm condition by detecting station 369. The first output pulse (called FRP) does not pass through AND gate 208. If in the next cycle, a second output pulse due to an alarm condition is sensed by detecting station 369, this pulse will pass through gate 208 since the alarm condition was detected at the same location on two consecutive cycles. After the requirement that the same alarm condition is sensed by the same detecting station during two consecutive cycles is met (causing pin 1 of counter 206 to go high), pin 6 will stay high and all subsequent indications of a detected alarm condition will be gated through AND gate 208 to generate the F/2 signal since a real alarm condition has been ascertained by initial use of the 2× logic circuitry.

The system also includes a BDSENSE circuit. When all of the boards making up the system are in proper position, BDSENSE is high. This high is coupled through resistor 570 (1 M) (FIG. 6(*a*)) to NAND gate 572 (4011) with the junction of resistor 570 and NAND gate 572 having a resistor 574 (10 M) to ground connected thereat. The output of NAND gate 572 is coupled through diode 576 to provide a GENTBL output that is low when BDSENSE is high. If there is an unplugged board, this causes BDSENSE to go low, and causes a high to be grated onto the GENTBL through diode 576.

The system also includes a self-test mode. In this mode, TSTSEL is forced low and coupled through inverter 224 (FIG. 6(*c*)) to pin 15 of RAM 46 (FIG. 6(*d*)). When reset is depressed and released, TSTSEL is now still held low during $\overline{RESET\ 1}$ since this signal is provided by the output of NAND gate 580 (FIG. 7(*b*)) the inputs to which are provided by NAND gate 582, which gate receives as inputs RESET 1 and $\overline{TESTSW2}$, and NAND gate 584, which gate receives as an input the output of NAND gate 586 (which also receives the $\overline{TESTSW2}$ input).

Thus, RAM 46 has a high during RESET. In this condition, a "1" is written into every RAM address and system operation proceeds as described hereinabove, except that in the READ mode, an alarm will be displayed at every location 1 through N, and the printer will print out data if selected.

In the self-test mode, RTEN also goes high at the input to NAND gate 468 (FIG. 6(*c*)). FRP/2 is thus produced by DOS when the RAM outputs DOS at every address. This capability allows the zone cards to respond as their lower limits are matched. The self-test mode is released by again depressing and releasing RESET. Thus, the self-test checks on the entire system for the internal logic.

As mentioned hereinabove, the voltages for RAM 46 are +5.1 volts as opposed to the +13.5 volts for the CMOS circuitry of the logic. This +5.1 volts is generated by coupling the +13.5 volts through resistor 590 (560 ohms) (FIG. 6(*a*)) having parallel connected capacitors 592 (0.01 μFd) and 593 (33 μFd) at one side and Zener diode 595 (5.1 volts) (1N751) at the other side so that the output of 5.1 volts is coupled therefrom. In addition, the +13.5 volts and return (ground) as a parallel connected capacitors 596 (33 μFd) (FIG. 7(*a*)) and 597 (0.01 μFd) connected therebetween.

In this system, a scanning zone board is utilized for zone alarm indications. A portion of such an overall board is shown in the drawings (FIG. 8) (there is an upper zone and a lower zone which are identical in logic).

Figure 8A:
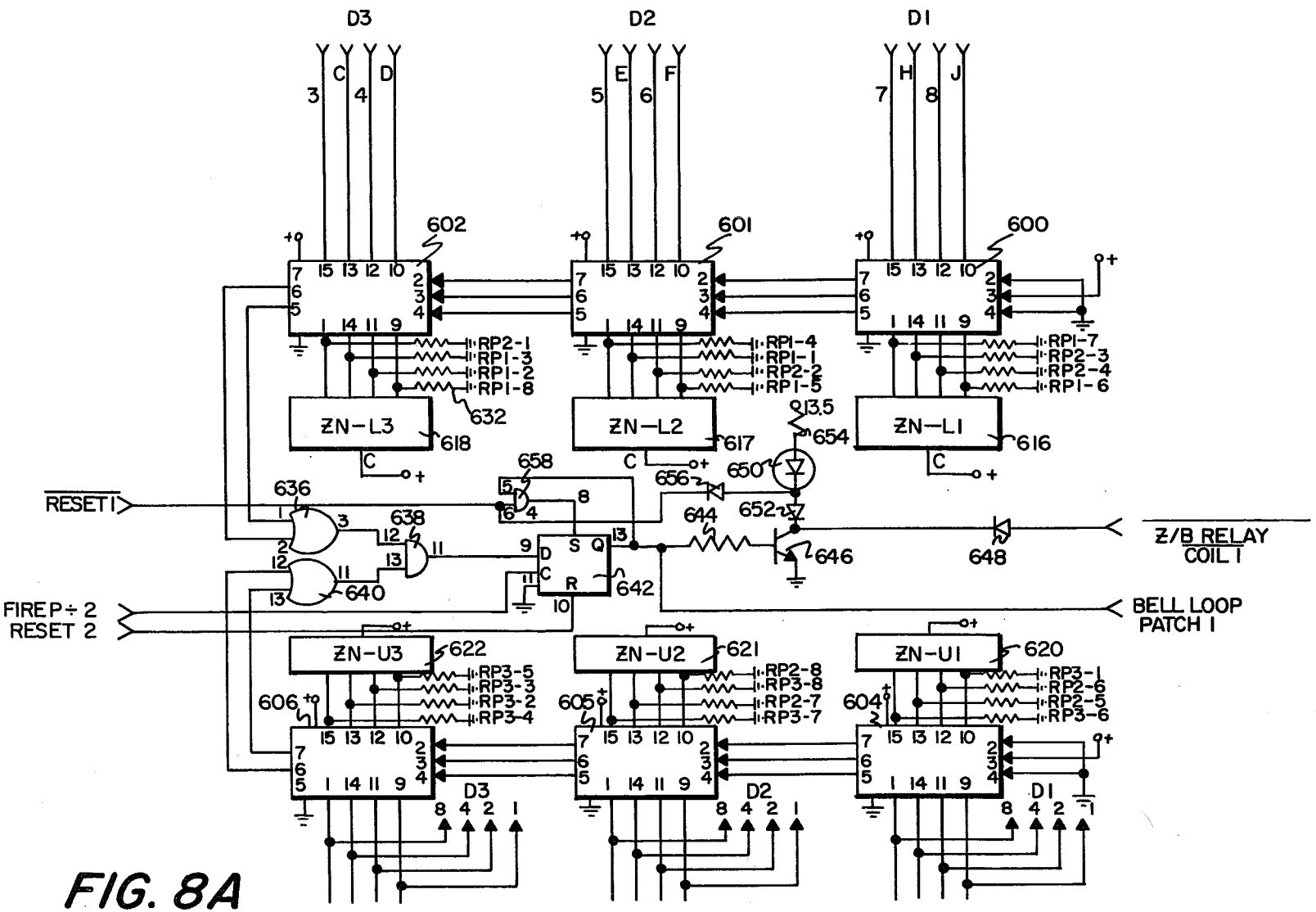
FIGS. 8(*a*) and 8(*b*), taken together, form an electrical schematic diagram of a portion of the scanning zone board utilized in this invention.
Figure 8B:
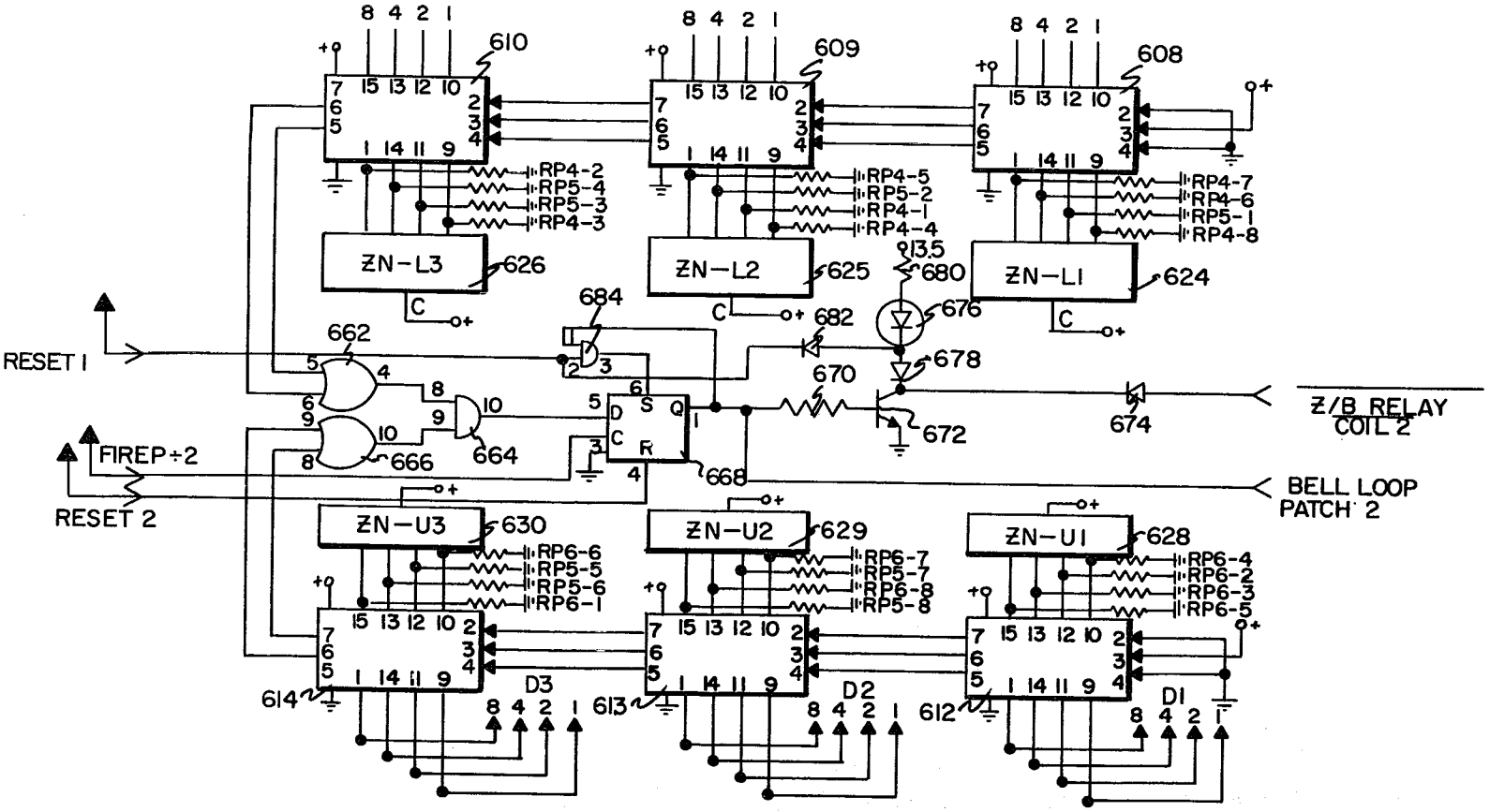

As shown in FIGS. 8(*a*) and 8(*b*), the outputs from the D lines are coupled to four sets of units, tens and hundreds counters 600, 601 and 602; 604, 605 and 606; 608, 609 and 610; and 612, 613 and 614 (all 4063s). Each of these counters has connected therewith zone limit switches 616, 617 and 618; 620, 621 and 622; 624, 625 and 626; 628, 629 and 630, respectively, with each of the pins having a resistor (designated generally 632) to ground connected therewith. Zone limit switches are preprogrammed as desired by the user.

The output of counter 602 (at pins 5 and 6) is coupled through OR gate 636 (4071) (FIG. 8(*a*)) to AND gate 638 (4081) while the output of counter 606 is coupled through OR gate 640 (4071) to AND gate 638 with the output of AND gate 638 being coupled as the D input to flip-flop 642 (4013). These gates are used to output a logic high on the AND gate when any function is less than or equal to the upper limit switches or greater than or equal to the lower limit switches.

The Q output from flip-flop 642 is coupled through resistor 644 (10K) to the base of transistor 646. The output is coupled from the collector of transistor 646 through diode 648 (1N4148) as $\overline{\text{Z/BRELAYCOIL1}}$, and the collector is also connected to the +V power supply through series connected diode 650 (or LED) and 652 (1N4004) and resistor 654 (1K), with the junction of diodes 650 and 652 being connected to $\overline{\text{RESET 1}}$ through diode 656 (1N4004). A relay switch is also commonly utilized. In addition, the set input to flip-flop 642 is connected to the output of AND gate 658 (4081) which receives as inputs $\overline{\text{RESET 1}}$ and the Q output of flip-flop 642.

In like manner the output of counter 610 (at pins 5 and 6) is coupled through OR gate 662 (4071) to AND gate 664 (4081), while the output of counter 614 (at pins 5 and 6) is coupled through OR gate 666 (4071) to AND gate 664 with the output from AND gate 664 being coupled as the D input to flip-flop 668 (4013). The Q output from flip-flop 668 is coupled through resistor 670 (10K) to the base of transistor 672. The output is coupled from the collector of transistor 672 through diode 674 (1N4148) as $\overline{\text{Z/BRELAYCOIL2}}$ and the collector is also connected to the +13.5 volt power supply through series connected diodes 676 and 678 (1N4004) and resistor 680 (1K), with the junction of diodes 676 and 678 being connected to $\overline{\text{RESET 1}}$ through diode 682 (1N4004). In addition, the set input to flip-flop 668 is connected to the output of AND gate 684 (4081) which receives as inputs $\overline{\text{RESET 1}}$ and the Q output of flip-flop 668.

Basically, any time a detecting station is within a zone, which has its programmable upper and lower limits and that detecting station senses an alarm condition, an alarm from that zone card is actuated to display an alarm for the zone which can include lighting a specific LED when the alarm comes into that zone. For testing the zones, the RTEN input to NAND gate 468 (FIG. 6(*c*)) effectively bypasses the 2× logic and allows data to be gated through NAND gate 472 to generate the FRP/2 output.

The system also includes acknowledge circuitry that has a couple of exclusive OR gates 688 and 690 (4030) (FIG. 7(*c*)) connected to receive the outputs of counters 692 and 694 (4013), respectively. The D input to counter 692 is coupled from the Q output of counter 696 (FIG. 7(*b*)), while the D input of counter 694 is coupled from the Q input of counter 698 (FIG. 7(*c*)). Counters 696 and 698 receive reset inputs of WTOS and RESET 1 through diodes 700 and 702, respectively (FIG. 7(*b*)), with the reset inputs being connected with ground through resistor 704 (1 M).

The outputs from the exclusive OR circuits 688 and 690 (FIG. 7(*c*)) are coupled through diodes 706 and 708, respectively, to the D input of counter 710 (4013), which input has a resistor 712 (1 M) to ground connected thereat. The Q output of counter 710 is connected back to the D input through capacitor 715 and coupled through diode 716 and resistor 718 (10K) to the base of transistor 720 (2N2222) with the junction of diode 716 and resistor 718 having a resistor 721 (1 M) to ground connected thereat and an RTEN input through diode 722. The collector of transistor 720 is connected to the emitter of transistor 724 (2N2222) which receives the $\overline{\text{BELLSIL}}$ (switch 5) input through resistor 726 (10K) and provides the $\overline{\text{ACK}}$ output from the collector.

The acknowledge circuitry gives the user the capability of acknowledging alarm conditions such that when an alarm comes in and the alarm sounds, the alarm can be silenced but will still allow the logic to respond again and allow a subsequent alarm to sound. If either of transistors 720 and 724 are turned off, the bells are disabled. Transistor 724 is turned off when $\overline{\text{BELLSILSW5}}$ is low, this being the standard bell silence switch. Transistor 720 is turned off when both RTEN and $\overline{\text{ACKEN}}$ are low (RTEN is low except during test and $\overline{\text{ACKEN}}$ is low after reset. $\overline{\text{ACKEN}}$ goes high turning on transistor 720 after the first FRP/2 clocks counters 696 and 698 so that the next RDOS clocks counter 710 to turn on transistor 720 and clock $\overline{\text{ACKEN}}$ high. If ACKCLK goes high (which occurs if the acknowledge switch is depressed), then the output of counter 710 goes low when the next RDOS occurs to turn off transistor 720 and silence the bells, which bells will remain silenced as long as only the one FRP/2 occurs once each WRITE cycle after WTOS resets counters 696 and 698. If either more or fewer FRP/2s occur during any subsequent WT cycle, the logic will again increment as described hereinabove and transistor 720 will be turned on so that the bells will again ring.

A printer select switch may be included, if desired, for interfacing a printer to the system. Such a printer will take the same D line data outputs which are available and which as discussed hereinabove are used to drive the seven segment display 54 with the necessary required time signals being generated in printer/driver logic 52. For use of a printer, a ready signal is coupled to printer/driver logic 52 and the printer provides an acknowledge return which allows the ready signal to go back high (the signal went low when coupled to the printer).

The reset signals are generated by the circuitry associated with counter 730 (4020) (FIG. 7(*a*)). The RESETSW1 input is coupled through capacitor 732 (1000PF), having resistor 734 (0.1 M) to ground connected at one side thereof, with the positive edge being differentiated and a positive pulse (INITRST) being coupled therefrom to the set input of counters 736, 737 and 738 (4043s), which counters act as latches. The Q output of latch 736 provides an output RESET 0, the Q output of latch 737 provides an output RESET 1 and the Q output of latch 738 provides an output of RESET 2. In addition, the Q outputs of latches 737 and 738 are coupled through inverters 740 and 741, respectively, to provide $\overline{\text{RESET 1}}$ and $\overline{\text{RESET 2}}$ outputs, respectively.

Counter 730 receives the $\phi$ input with the Q1 output being connected with AND gate 743, which gate has a second input connected with the Q13 output of counter 730 and provides an output to the R input of latch 738. The Q4 output of counter 730 is connected to the R input of latch 736, with the Q11 output being coupled through latch 744 (4043) to capacitor 745 (1000PF), having diode 746 connected to ground thereto, to provide RSRDOS output, with the Q12 output being coupled through latch 747 to capacitor 748 (1000PF), having diode 749 to ground connected thereto, to provide the RSINTOS output and through capacitor 750 (1000PF), having diode 751 to ground connected thereto, to provide the RSWTOS output, and with the Q13 output being coupled to the R input of latch 737. In addition, the $\overline{\text{RESET 2}}$ output is coupled to the R input (pin 11) of counter 730.

The Q outputs of latches 736, 737 and 738 are set high to provide the RESET 0, RESET 1 and RESET 2 outputs, respectively, (as well as the same signal inverted through the inverters) when the INITRST signal is equal to these latches. This supplies the RESET 2 output to pin 11 of counter 730 as a low thereat. This allows counter 730 to count $\phi$ pulses coupled at pin 10 of the counter. When Q4 of counter 730 provides an output, RESET 0 is driven low through latch 736 making RESET 0 16 msec wide. The counter 730 provides an output at Q11 (1.5 sec) where the RSRDOS signal is outputted. When counter 730 provides an output at Q12 (3 sec), the RSINTOS and RSWTOS signals are outputted. When counter 730 provides an output at Q13 (6 sec), RESET 1 is driven low by latch 737. At a time equal to the outputs of Q13 plus Q1 (6,002 msec), RESET 2 is driven low through latch 738 and this allows the OSO output to switch the READ/WRITE flip-flop 254 to READ mode and not strobe trouble data into the delay at that time.

A trouble buzzer 752 (FIG. 7(*a*)) is connected with the collector of transistor 754 (2N2222), the base of which is connected to receive the output of NAND gate 756 (4011) through resistor 758 (10K). NAND gate 756 receives an input from the output of NAND gate 760 and the other output from the output of NAND gate 762. NAND gate 760 receives the DISCBUS input through diode 764 and the GENFIRE input through diode 765, the RESET 2 input through diode 766, the RMTBL through serially connected diodes 767 and 768, and the TBLCOM input through diode 768, and the $\overline{\text{BUZZSILSW4}}$ input at the other input. NAND gate 762 receives the signals coupled through diodes 764–768 except that the signals are coupled through inverter 769 at one input and receives, at the other input, the output of NAND gate 770, with NAND gate 770 receiving the BUZZSILSW4 as its input. In addition, diodes 764, 765, 766 and 768 are connected with ground through resistor 771 (1 M).

Of these signal inputs, only RESET 2 is incapable of activating buzzer 752 since $\overline{\text{BUZZSILSW4}}$ is held low during reset time. In normal operation, after any qualified signal input has activated buzzer 752, the buzzer can be silenced by activating the trouble silence switch to drive $\overline{\text{BUZZSILSW4}}$ low to disable an output at NAND gate 756. When the trouble conditions are restored to normal, the buzzer sounds again to provide ringback.

If trouble is detected, a high (TBLCOM) is coupled through resistors 772 (4.7K) and 773 (4.7K) (FIG. 7(*b*)), inverter 774 and resistor 775 (10K) to the base of transistor 777 (2N2222). The collector of transistor 777 (providing an output $\overline{\text{TRBLREL}}$) is connected with the +V power supply through resistor 778 (10K), the junction of resistor 773 and inverter 774 has a resistor 780 (1 M) to ground thereat, and the junction of resistors 772 and 773 has a capacitor 781 (0.47 $\mu$Fd) to ground thereat. In addition, the Q output of latch 783 (4043) is connected to resistor 772 through diode 784 with latch 783 receiving the OSO signal as the set input and receiving the output of AND gate 786 through diode 788 as the reset signal along with RESET 2 through diode 790, the reset input also having a resistor 792 (1 M) to ground connected thereto. The Q output of latch 783 is also coupled through inverter 794 to provide the $\overline{\text{TBL}}$ output.

When any trouble is gated high onto TRBLCOM, the high is delayed by resistors 772 and 773 and capacitor 781, inverted to a low by inverter 774, and then coupled to transistor 777 to turn off the transistor. TBL which is indicative of trouble on the loop is generated if OSO is received. This sets latch 783 high where it remains until reset by an output from AND gate 786 or by RESET 2. Therefore, trouble does not latch.

An indication of a detected alarm (fire) is generated at the Q output of latch 796 (4043) which is set high by FRP/2 and resets only by RESET 2 (and therefore FIRE does latch). A GENFIRE output is provided at the output of latch 796 with the output also being coupled through resistor 798 (10K) to the base of transistor 800 (2N2222) the collector of which is connected to the +V power supply through resistor 802 (10K) and provides a $\overline{\text{GENFIRE}}$ output. In addition, the $\overline{\text{FIRE}}$ output is coupled through inverter 804 to provide a FIRE input to the D input of counter 566. The FIRE signal is prevented by $\overline{\text{BL}}$ (at the collector of transistor 556) (FIG. 7(*b*)) by one extra scan to inhibit the data display from occurring too early. This occurs due to ST gating $\overline{\text{FIRE}}$ through counters 564 and 566.

The interconnection of D lines is indicated as above. As shown in FIG. 7(*b*), each D line is coupled through a resistor (designated generally as 808 and typically 1 M), inverted by inverter 810 included in circuits 812 and 814, and coupled through a second resistor (designated generally as 816 and typically 10K) to the base of transistor 817. Each output is taken from the collector which also has a resistor 818 (10K typically) to ground. Although only two such counters are shown, each is identical for each connection.

In addition, the output signals are also routed to the pins shown in ICs 406, 407 and 408 (which are digital comparators) (FIG. 7(*c*)). These counters, along with top count switches 402, 403 and 404 comprise TPCNT=signal generation. When the BCD number on the D lines reaches the BCD number programmed into the top count switches, pin 6 of IC408 goes high to generate TPCNT=.

$\overline{\text{DISC}}$ is obtained by inverting the DISCBUS input to the base of transistor 820 (2N2222) (FIG. 7(*b*)) coupled through resistor 822 (10K) having a resistor 824 (1 M) to ground connected therewith, $\overline{\text{DISC}}$ being coupled from the collector of transistor 820 which has a resistor 826 (10K) to the +V power supply connected thereto. PRTRB is obtained by inverting $\overline{\text{PRTRSW3}}$ by means of NAND gate 828.

The ACKCLK output is provided at the Q output of flip-flop 832 (4013) (FIG. 9(*c*)) which output is also coupled as the $\phi$ input to flip-flop 834 (4013). The Q output from flip-flop 834 is coupled through diode 836 to provide the IDISC output and through diode 838 and resistor 840 (100K) to the base of transistor 842. The collector of transistor 842 is coupled to one side of LED 844 the other side of which is connected through resistor 846 (2.7K) to the movable contact of switch 848 (ACKN switch S6) the fixed contact of which is connected with the set input of flip-flop 832 and with ground through resistor 850 (1 M), with the reset of flip-flop 832 also being connected to ground through resistor 852 (1 M). An LT input is provided to reset flip-flop 834 with this input also being coupled through diode 854 to the junction of diode 838 and resistor 840 (100K), which junction has a resistor 856 (100K) to ground connected thereat.

For display purposes, a plurality of LEDs are utilized. The $\overline{\text{SYSNRM}}$ input is coupled through diode 860 (FIG. 9(*b*)), resistor 862 (1 M), inverter 864 (4069) and resistor 866 (10K) to the base of transistor 868 with the junction of diode 860 and resistor 862 having a resistor 870 (10K) to the +13.5 volt power supply connected thereat and receiving the $\overline{\text{LT}}$ input through diode 872. The collector of transistor 868 is connected to the power supply through parallel connected resistors 874 (2.7K) and 876 (2.7K) and LED 878 which is the SYSNORM indication (preferably green).

The $\overline{\text{GENFIRE}}$ input is coupled through diode 880, resistor 882 (1 M), inverter 884 (4069) and resistor 886 (10K) to the base of transistor 888 with the junction of diode 880 and resistor 882 being connected to the +13.5 volt power supply through resistor 890 (10K) and an $\overline{\text{LT}}$ input coupled thereto through diode 892. The collector of transistor 888 is connected to the power supply through parallel connected resistors 894 (2.7K) and 896 (2.7K) and LED 898, which LED is the GENFIRE indication and is preferably red.

The TBLREL input is coupled through diode 900 and resistor 902 (100K) to the base of transistor 904 with the base also being connected to ground through resistor 906 (100K) and the LT input coupled to the junction of diode 900 and resistor 902 through diode 908. The collector of transistor 904 is connected to the power supply through parallel connected resistors 910 (2.7K) and 912 (2.7K) and LED 914, which LED is TRBL indication and preferably is yellow.

The $\overline{\text{DISC}}$ input and $\overline{\text{LT}}$ input are coupled through diodes 916 and 917, respectively (FIG. 9(*c*)), and parallel connected resistors 918 (2.7K) and 920 (2.7K) (FIG. 9(*b*)) to LED 922, which LED is the DISC indication and preferably is yellow.

The $\overline{\text{BTLED}}$ input is coupled through diode 924 (FIG. 9(*c*)) to LED 926, along with the $\overline{\text{LT}}$ input coupled through diode 928 and resistor 930 (2.7K), LED 926 being the BATTBL indication and preferably is yellow.

The $\overline{\text{GFLED}}$ input is coupled through diode 932 to LED 934, along with the $\overline{\text{LT}}$ input coupled thereto through diode 936 and resistor 938 (2.7K), LED 934 being the GNDFLT indication and preferably is yellow.

The system also includes a plurality of momentary switches 940, 941, 942, 943 and 944 (as well as switch 848—ACKN).

Switch 940 (S1) (FIG. 9(*b*)) is the reset switch and has one fixed contact connected with the +13.5 volt power supply and the other fixed contact connected to ground through resistor 946 (1K). This switch provides low to high transition (RESETSW1) required to institute reset from the movable contact. The RESETR input, also on the movable contact, provides capability for generating reset remotely.

Switch 941 (S2) is the test switch and has an LED 948 connected to the movable contact through resistor 949 (2.7K). One fixed contact of switch 941 is connected to the set input of flip-flop 950 (4013) and to ground through resistor 952 (1 M), while the other fixed contact is connected to the reset input of flip-flop 950 and to ground through resistor 954 (1 M). The Q output of flip-flop 950 is connected to the $\phi$ input of flip-flop 955, the reset input to which receives the RESET 0 input through inverter 956 (4069) and capacitor 957 (1000PF) having a resistor 958 (1 M) to ground connected thereto. The Q output of flip-flop 955 is connected to the D input of flip-flop 959. The Q output of flip-flop 959 provides IDISC output through diode 960 and is connected with the base of transistor 961 (2N2222) through diode 962 and resistor 964 (100K), the junction of which is connected to the Q output of flip-flop 955 through diode 965. The collector of transistor 961 is connected to the other side of LED 948 and the junction of diode 962 and resistor 964 receives the LT input through diode 966 and is connected to ground through resistor 968 (100K). The $\overline{\text{Q}}$ output of flip-flop 956 provides the $\overline{\text{TESTSW2}}$ output.

Switch 942 (S3) is the printer switch and has an LED 970 connected to the movable contact through resistor 971 (2.7K). One fixed contact of switch 942 is connected to the set input of flip-flop 972 (4013) and to ground through resistor 974 (1 M), while the other fixed contact is connected to the reset input of flip-flop 972 and to ground through resistor 976 (1 M). The Q output of flip-flop 972 is connected to the $\phi$ input of flip-flop 978. The Q output of flip-flop 978 is connected with the base of transistor 980 (2N2222) through diode 982 and resistor 984 (100K). The collector of transistor 980 is connected to the other side of LED 970 with the output $\overline{\text{PRTRSW3}}$ being taken from the collector of transistor 980, which collector has a resistor 985 (1 M) to the +13.5 volt power supply connected thereto. The junction of diode 982 and resistor 984 receives the LT input, as does the reset input of flip-flop 978, through diode 986 and is connected to ground through resistor 988 (100K).

Switch 943 (S4) (FIG. 9(*c*)) is a trouble silence switch and has an LED 990 connected to the movable contact through resistor 991 (2.7K). One fixed contact of switch 943 is connected to the set input of flip-flop 992 (4013) and to ground through resistor 994 (1 M), while the other fixed contact is connected to the reset input of flip-flop 992 and to ground through resistor 996 (1 M). The Q output of flip-flop 992 is connected to the $\phi$ input of flip-flop 998 (4013). The Q output of flip-flop 998 is connected with the base of transistor 1000 (2N2222) through diode 1002 and resistor 1004 (100K). The collector of transistor 1000 is connected to the other side of LED 990 and the output $\overline{\text{BUZZSILSW4}}$ is taken from the collector of transistor 1000, which collector has a resistor 1005 (1 M) to the +13.5 volt power supply connected thereto. The junction of diode 1002 and resistor 1004 receives the LT input, as does the reset input of flip-flop 998, through diode 1006 and is connected to ground through resistor 1008 (100K).

Switch 944 (S5) is the bell silence switch and has an LED 1010 connected to the movable contact through resistor 1011 (2.7K). One fixed contact of switch 944 is connected to the set input of flip-flop 1012 (4013) and to ground through resistor 1014 (1 M), while the other fixed contact is connected to the reset input of flip-flop 1012 and to ground through resistor 1016 (1 M). The Q output of flip-flop 1012 is connected to the $\phi$ input of flip-flop 1018 (4013). The Q output of flip-flop 1018 provides the IDISC output through diode 1020 and is connected with the base of transistor 1022 (2N2222) through diode 1024 and resistor 1026 (100K). The collector of transister 1022 is connected to the other side of LED 1010 with the $\overline{\text{BELLSILSW5}}$ taken from the collector of transistor 1022, which collector has a resistor 1027 (1K) to the +13.5 volt power supply connected thereto. The junction of diode 1024 and resistor 1026 receives the LT input, as does the reset input of flip-flop 1018, through diode 1028 and is connected to ground through resistor 1030 (100K).

In typical operation of these switches, switch 942, for example, maintains a high on the reset input of flip-flop 972 and a low at the set input and Q output. When $\overline{\text{LT}}$ goes low during reset, this forces the Q output of flip-flop 978 low. When switch 942 is depressed, a high is ultimately placed on the Q output of flip-flop 978. Release of switch 942 leaves the high Q output at flip-flop 978. This turns on transistor 980 and the saturated collector of the transistor holds LED 970 on, and outputs $\overline{\text{PRTRSW3}}$ low. When switch 942 is then depressed, transistor 980 is turned off and $\overline{\text{PRTRSW3}}$ goes high and LED 970 is de-energized.

Figure 10A:
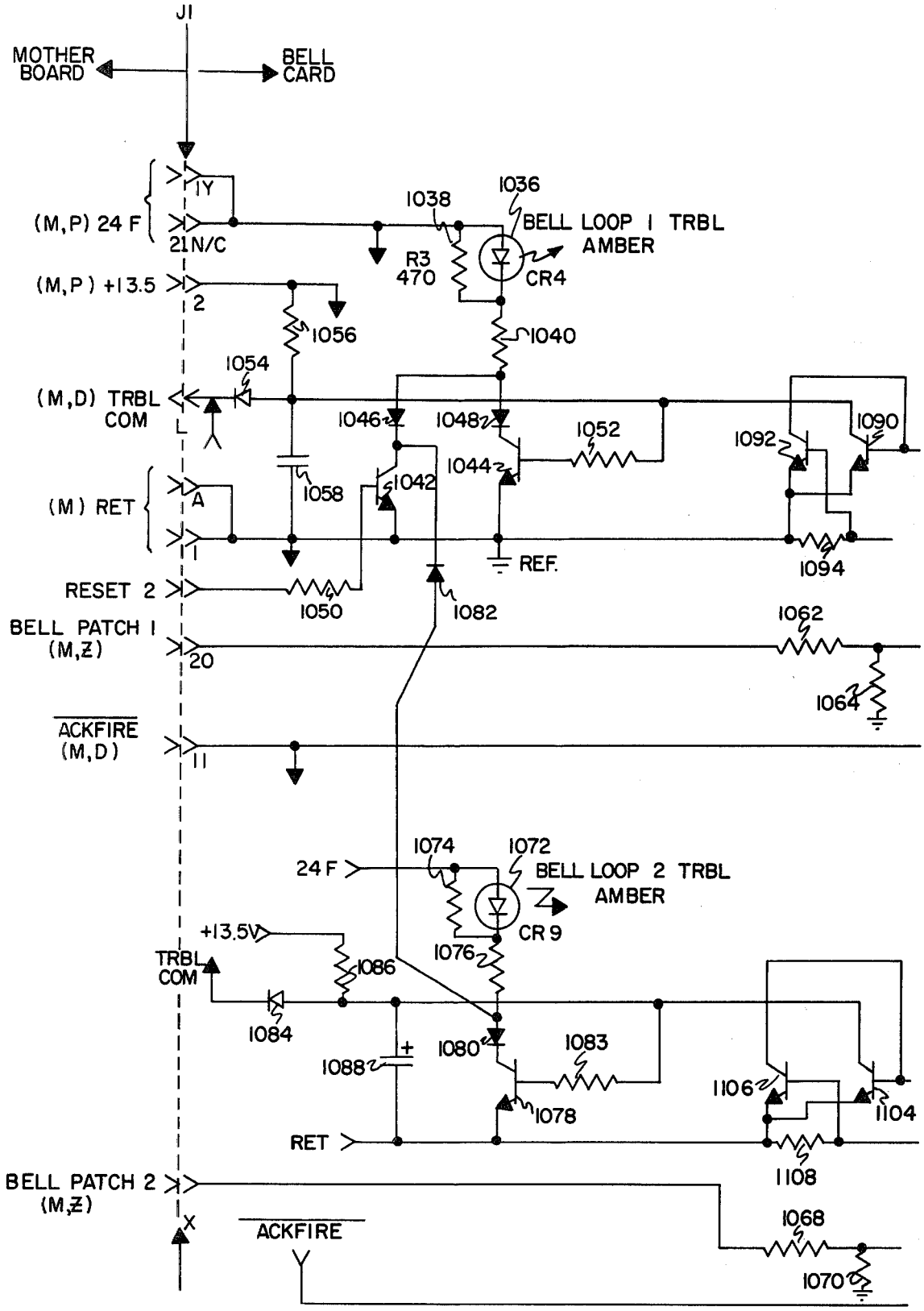
FIGS. 10(*a*) and 10(*b*), taken together, form an electrical schematic diagram of the bell card and relays of the control system utilized in this invention.
Figure 10B:
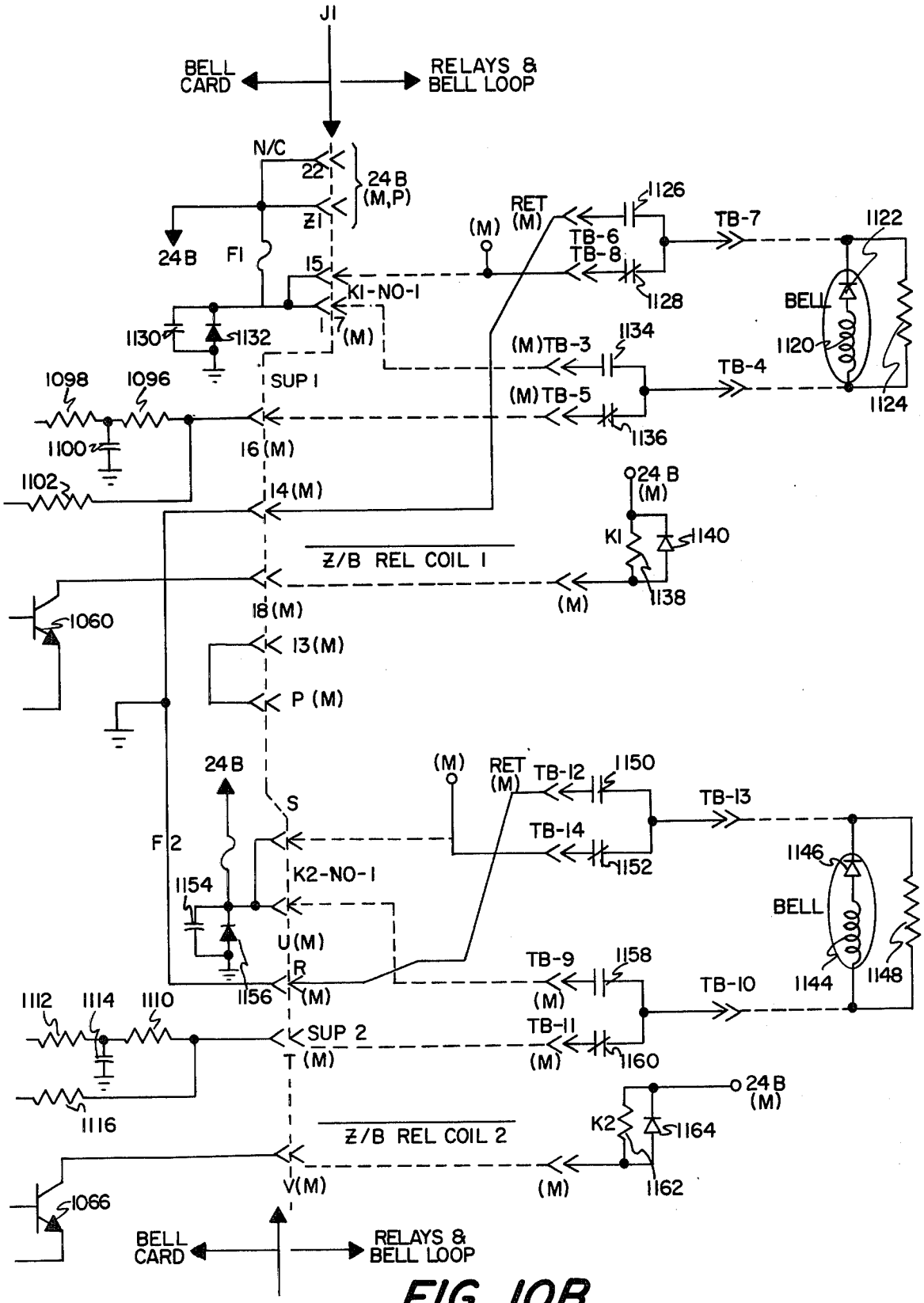

Referring now to FIG. 10, the 24F input is coupled to one side of LED 1036 (FIG. 10(*a*)), having a resistor 1038 (470 ohms) in parallel therewith, with the other side of the LEd being connected through resistor 1040 (2.7K) to transistors 1042 and 1044 through diodes 1046 and 1048 (1N4004), respectively. The base of transistor 1042 is connected with RESET 2 through resistor 1050 (10K), while the base of transistor 1044 is connected to TRBLCOM through resistor 1052 (100K) and diode 1054 (1N4148). The junction of resistor 1052 and diode 1054 is connected to the +13.5 volt power supply through resistor 1056 (10K) and to ground through capacitor 1058 (10 $\mu$Fd).

The $\overline{\text{ACKFIRE}}$ input is coupled to the emitter of transistor 1060 (FIG. 10(*b*)), the base of which is connected to the BELLPATCH1 input through resistor 1062 (10K) (FIG. 10(*a*)) and to ground through resistor 1064 (10K). The $\overline{\text{ACKFIRE}}$ input is also coupled to the emitter of transistor 1066 (FIG. 10(*b*)), the base of which is connected to the BELLPATCH2 input through resistor 1068 (10K) (FIG. 10(*a*)) and to ground through resistor 1070 (10K).

The 24F input is coupled to one side of LED 1072 (FIG. 10(*a*)), having a resistor 1074 (470 ohms) in parallel therewith, with the other side of the LED being connected through resistor 1076 (2.7K) to the collector of transistor 1078 through diode 1080 (1N4004) and to the collector of transistor 1042 through diode 1082 (1N4004). The base of transistor 1078 is connected through resistor 1083 (100K) and diode 1084 (1N4148) to TRBLCOM, the +13.5 volt power supply through resistor 1086 (10K), and to the return through capacitor 1088 (10 $\mu$Fd).

The collector of transistor 1090 is connected with TRBLCOM through diode 1054, while the collector of transistor 1092 is connected to the base of transistor 1090, and the emitter of transistor 1090 is connected with ground while the emitter of transistor 1092 is connected to ground through transistor 1094 (150 ohms). The input to the base of transistor 1090 is coupled through serially connected resistors 1096 (2.2K) and 1098 (2.2K) (FIG. 10(*b*)) having a capacitor 1100 (33 $\mu$Fd) to ground connected to the junction of these resistors, and the input is also coupled to the base of transistor 1092 through resistor 1102 (1.5K).

The collector of transistor 1104 (FIG. 10(*a*)) is connected to the TRBLCOM output through diode 1084, while the collector of transistor 1106 is connected to the base of transistor 1104, and the emitter of transistor 1104 is connected with the return while the emitter of transistor 1106 is connected with the return through resistor 1108 (150 ohms). The input to the base of transistor 1104 is coupled through serially connected resistors 1110 (2.2K) and 1112 (2.2K) (FIG. 10(*b*)) having a capacitor 1114 (33 $\mu$Fd) to ground connected to the junction of the resistors, and the input is also coupled to the base of transistor 1106 through resistor 1116 (1.5K).

Bell actuating relay winding 1120 (FIG. 10(*b*)) is connected in series with diode 1122 with winding 1120 and diode 1122 having a resistor 1124 (10K) in parallel therewith. This circuitry is plugged into the bell card at one side through normally open switch 1126 to ground and normally closed switch 1128 connected with ground through parallel connected capacitor 1130 (0.1 $\mu$Fd) and diode 1132 (1N4004), and at the other side through normally open switch 1134 to capacitor 1130 and diode 1132 and through normally closed switch 1136 to resistor 1096. The collector of transistor 1060 is connected to relay coil 1138 having diode 1140 in parallel therewith.

Bell actuating relay winding 1144 is connected in series with diode 1146 with winding 1144 and diode 1146 having a resistor 1148 (10K) in parallel therewith. This circuitry is plugged into the bell card at one side through normally open switch 1150 to ground and normally closed switch 1152 with ground through parallel connected capacitor 1154 (0.1 $\mu$Fd) and diode 1156 (1N4004), and the other side through normally open switch 1158 to capacitor 1154 and diode 1156 and through normally closed switch 1160 to resistor 1110. The collector of transistor 1066 is connected to relay coil 1162 having diode 1164 in parallel therewith.

Figure 11A:
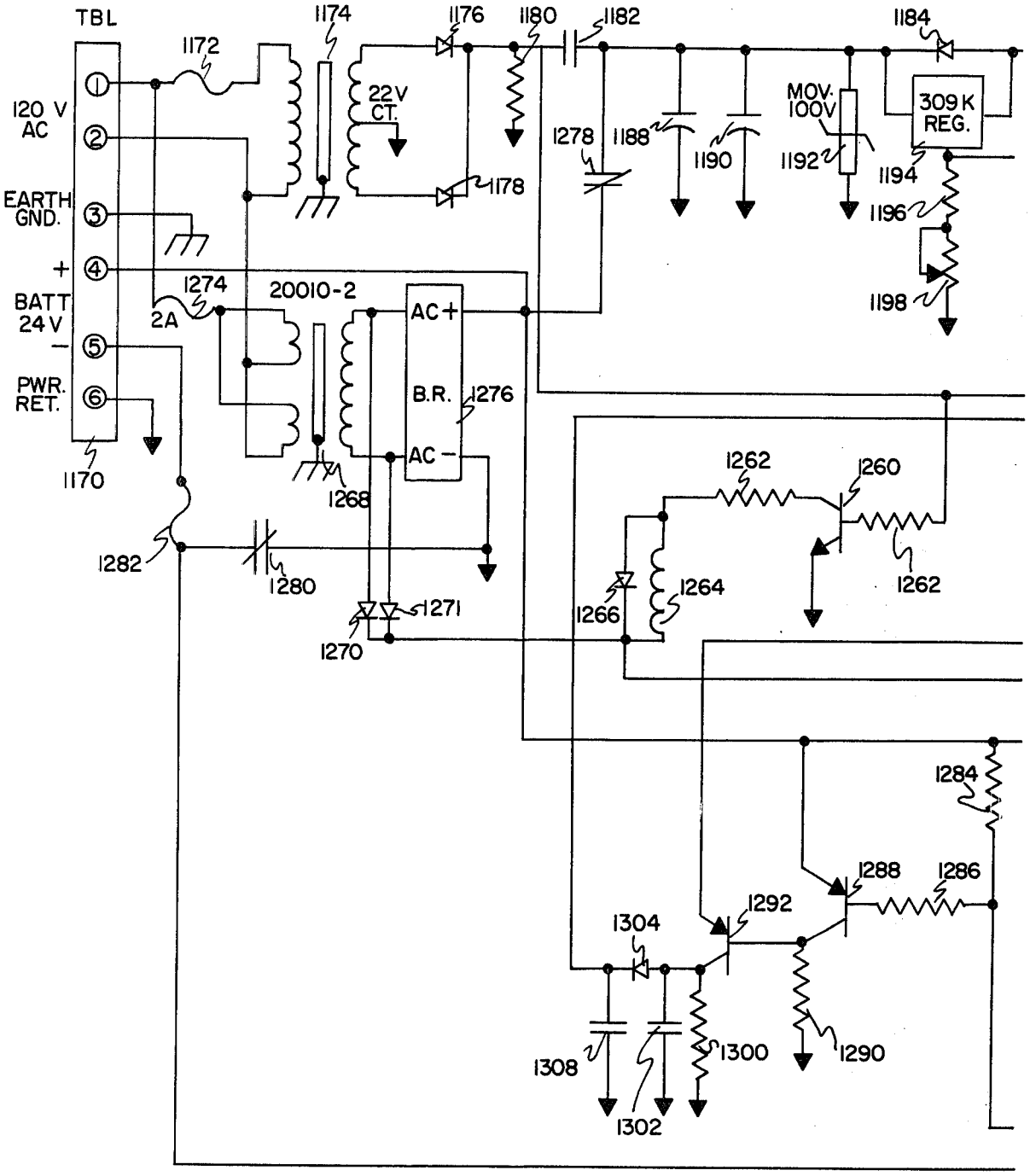
FIGS. 11(*a*) and 11(*b*), taken together, form an electrical schematic diagram of the power supply utilized in this invention.
Figure 11B:
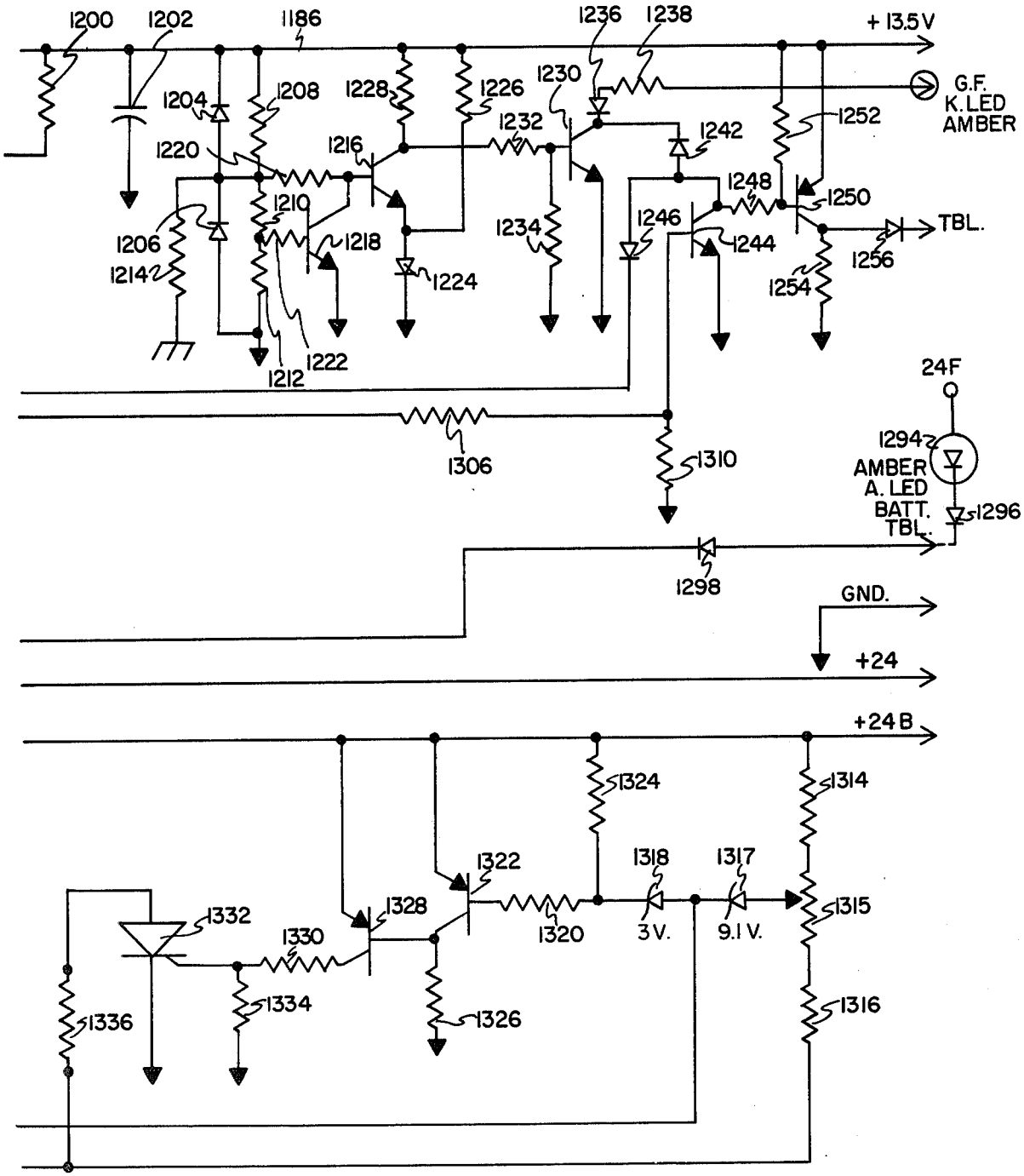

The power supply for this system is shown in FIG. 11. The system uses a 120 volt AC input at input terminal 1170 (FIG. 11(*a*)), which is coupled through fuse 1172 (½A) to the primary of step-down transformer 1174 (P8603). The secondary winding of transformer 1174 has the center tap grounded with full wave rectification provided by diode rectifiers 1176 and 1178 (1N4004s) having a resistor 1180 (10K) to ground connected at the cathode side thereof.

As shown, a normally open relay contact 1182 is connected to diode 1184 (1N4004) on the +13.5 voltage output line 1186. At the cathode side of diode 1184, a pair of capacitors 1188 (0.1 μFd) and 1190 (22PF) are connected therefrom to ground as is a MOV 1192 (100 V). A 309K regulator 1194 is connected in parallel with diode 1184, the regulator being connected to ground through resistor 1196 (360 ohms) and variable potentiometer 1198 (0–100 ohms). At the anode of diode 1184, a resistor 1200 (FIG. 11(*b*)) is connected to the junction of regulator 1194 and resistor 1196 (360 ohms), as is a capacitor 1202 (33 μFd) to ground.

A pair of serially connected diodes 1204 and 1206 (1N4004s) extend between the +13.5 volt line 1186 and ground as do three serially connected resistors 1208 (27K), 1210 (2.7K), and 1212 (270 ohms). The junction of diodes 1204 and 1206 and the junction of resistors 1208 and 1210 are connected with one another and to chassis ground through resistor 1214 (1K), and to the base and collector of transistors 1216 and 1218 (2N2222s) respectively, through resistor 1220 (10K). The base of transistor 1218 is connected to the junction of resistors 1210 and 1212 through resistor 1222 (1K), while the emitter of transistor 1216 is connected with ground through diode 1224 and to the +13.5 volt power supply through resistor 1226 (27K), and the collector of transistor 1216 is connected with the +13.5 volt power supply through resistor 1228 (27K) and to the base of transistor 1230 (2N2222) through resistor 1232 (27K) which base has a resistor 1234 to ground connected therewith.

The collector of transistor 1230 is connected through diode 1236 (1N4004) and resistor 1238 (2.7K) to the G.F.K.LED (amber). The collector of transistor 1230 is also connected through diode 1242 (1N4148) to the collector of transistor 1244 (2N2222) and through diode 1246 (1N4148) to diode rectifiers 1176 and 1178. The collector of transistor 1244 is also connected through resistor 1248 (100K) to the base of transistor 1250 (2N2907) the base of which is connected to the +13.5 volt power supply on lead 1186 through resistor 1252 (100K). The collector of transistor 1250 is connected with ground through resistor 1254 (10K) and the output is taken from the collector through diode 1256 (1N4148) to provide a TBL output.

Rectifier diodes 1176 and 1178 (FIG. 11(*a*)) are connected with the base of transistor 1260 (2N2222) through resistor 1262 (10K), with the collector of transistor 1260 being connected through resistor 1262 (82 ohms) to relay coil 1264 (K1-HL2 24DC), having diode 1266 (1N4004) in parallel therewith. The other end of relay coil 1264 and diode 1266 are connected with the secondary of transformer 1268 (200010-2) through diodes 1270 and 1271 (1N4004s). The primaries of transformer 1268 are connected with the 120 volt AC power supply at junction 1170 through fuse 1274 (2A). The secondary of transformer 1268 is rectified by a battery rectifier 1276 (MDA 2501) with the positive output being connected with rectifier 1184 through normally closed relay contact 1278 and with the positive battery junction at terminal 1170. The negative output is connected with ground and then normally closed relay contact 1280 and fuse 1282 (7A) to the negative junction at terminal 1170. Contacts 1182, 1278 and 1280 are controlled by relay 1264 (K1).

The +24 volt output is coupled from the power supply as +24 B and +24 volts, and is also coupled through resistor 1284 (100K) and resistor 1286 (10K) to the base of transistor 1288 (2N2907), the collector of which is connected with ground through resistor 1290 (10K) and to the base of transistor 1292 (2N2907). The emitter of transistor 1292 is connected with +24 F volts through battery trouble LED 1294 (amber) (FIG. 11(*b*)) and diodes 1296 and 1298 (1N4004s), while the collector is connected to ground through resistor 1300 (2.7K) (FIG. 11(*a*)) and capacitor 1302 (0.1 μFd) and through diode 1304 (1N4148) and resistor 1306 (100K) (FIG. 11(*b*)) to the base of transistor 1244. The junction of diode 1304 and resistor 1306 has a capacitor 1308 (0.1 μFd) connected therefrom to ground, while the base of transistor 1244 has a resistor 1310 (100K) (FIG. 11(*b*) connected therefrom to ground.

The +24 B voltage and the −24 volt battery terminal has connected therebetween resistor 1314 (2.2K), potentiometer 1315 (0–2K) and resistor 1316 (2.2K) forming a voltage divider. The center tap of potentiometer 1315 is connected through Zener diodes 1317 (9.1 V) (1N5239) and 1318 (3 V) (1N5226) and resistor 1320 (10K) to the base of transistor 1322 (2N2907). The junction of Zener diode 1318 and resistor 1320 is connected to the +24 B volt power supply through resistor 1324 (100K) while the junction of Zener diodes 1317 and 1318 is connected to the junction of resistors 1284 and 1286.

The collector of transistor 1322 is connected with ground through resistor 1326 (10K) and to the base of transistor 1328 (2N2907). The collector of transistor 1328 is connected through resistor 1330 (510 ohms) to the gate of silicon controlled rectifier 1332 (MCR 3918-3), which gate is connected with ground through resistor 1334 (47 ohms). SCR 1332 is connected between ground and the negative terminal of the 24 volt battery through resistor 1336 (10 ohms).

As can be appreciated from the foregoing, this invention provides an improved system for monitoring a plurality of detector stations and accurately determining therefrom the presence of one or more alarm conditions.

ADDENDUM MNEMONICS DICTIONARY

+12SW—+12 volts switched
+13.5—+13.5 volts DC used for VDD
16 KHZ—16 kilo hertz
24B-24 volts FWR battery back-up.
24F-24 volts full wave rectified
+5.1—+5.1 volts DC for RAM circuits
$\overline{\text{ACK}}$!-Acknowledge Factorial Not
ACKCLK-Acknowledge Clock
$\overline{\text{ACKEN}}$-Acknowledge Enable Not
$\overline{\text{ALARMREL}}$-Alarm Relay Not
BDSENSE-Board Sense
$\overline{\text{BELLSILSW5}}$-Bell Silence Switch 5 Not.
$\overline{\text{BL}}$-Blanking Not
$\overline{\text{BTLED}}$-Battery trouble LED Not
$\overline{\text{BUZZSILSW4}}$-Buzzer Silence Switch 4 Not
$\overline{\text{CS}}$-Chip Select Not
DFVER-Digital Filter Verify $\overline{\text{DISC}}$-Disconnect Not
DISCBUS-Disco Bus
DOS-Data One-Shot
F/2-Fire÷2
FIRE-Fire
$\overline{\text{FIRE}}$-Fire Not
FRP-Fire Pulses
FRP/2-Fire Pulses÷2
GENFIRE-General Fire
$\overline{\text{GENFIRE}}$-General Fire Not
GENTBL-General Trouble
$\overline{\text{GFLED}}$-Ground Fault LED Not
GTDTPCNT=-Gated Topcount Equal
IDISC-Indicator Disconnect
INITRST-Initial Reset
INTOS-Interrogate One-Shot
$\overline{\text{LT}}$-Lamp Test Not
OSO-One Shot Zero
PRTRA-Printer A
PRTRB-Printer B
$\overline{\text{PRTRSW3}}$-Printer Switch 3 Not
RD-Read
RDOS-Read One-Shot
RESET O-Reset Zero
RESET 1-Reset One
$\overline{\text{RESET 1}}$-Reset One Not
RESET 2-Reset Two
$\overline{\text{RESET2}}$-Reset Two Not
RESETR-Reset Remote
RESETSW1-Reset Switch One
RET-Return
RMTBL-Remote Trouble
RSINTOS-Reset Interrogate One-Shot
RSRDOS-Reset Read One-Shot
RSWTOS-Reset Write One-Shot
RTEN-Rolling Thunder Enable
STDRWCLK-Standard Read Write Clock
ST-Strobe
$\overline{\text{ST}}$-Strobe Not
$\overline{\text{STR}}$-Strobe Not
$\overline{\text{SYSNORM}}$-System Normal Not
$\overline{\text{TBL}}$-Trouble Not
TBLCOM-Trouble Common
TBLREL-Trouble Relay
$\overline{\text{TESTSW2}}$-Test Switch 2 Not
TOOMNYCHK-Too Many Check
TOOFEWCHK-Too Few Check
TOPCNT=-Topcount Equal
TPCNTDLY-Topcount Delay Not
TSTSEL-Test Select
$\overline{\text{WE}}$-Write Enable Not
WT-Write
WTOS-Write One-Shot
$\phi$-Phi, the clock
$\overline{\phi\text{CUTOFF}}$-Phi Cutoff Not
$\phi$PRTR-Phi Printer
$\phi$SYSNORM-Phi System Normal

What is claimed is:

1. A condition monitoring system, comprising:

interrogation means providing an interrogation pulse output;

a plurality of detecting means adapted to monitor a predetermined variable condition, each of said detecting means including receiving means for receiving interrogation pulses with said receiving means of a first of said detecting means being connected with said interrogation means to receive said interrogation pulse output therefrom and responsive thereto providing an interrogation pulse output, each of said detecting means being connected in series with one another so that said receiving means of each of said detecting means receives an interrogation pulse output from the immediately preceeding one of said detecting means with each of said detecting means, responsive to receipt of said interrogation pulse output coupled thereto, providing a data pulse output having a predetermined characteristic if said monitored variable condition is in a preselected state, and each said data pulse output being on a common output conductor with each detecting means providing said data pulse output at timewise spaced intervals so that a train of data pulses is coupled from said detecting means; and pulse processing means connected with said common output conductor to receive said train of data pulses and responsive thereto providing an indication of the state of said detecting means.

2. The monitoring system of claim 1 wherein said interrogation means and said first detecting means includes pulse generating means for providing a single pulse as said interrogation pulse output for each monitoring cycle of said system, and wherein each of said detecting means includes delay means for delaying production of said data pulse output from each succeeding detecting means for a predetermined period of time after production of said data pulse from said preceeding detecting means.

3. The monitoring system of claim 2 wherein said delay means delays production of said data pulse output from said succeeding detecting means for a predetermined period of time after production of said interrogation pulse output by said preceeding detecting means.

4. The monitoring system of claim 1 wherein each of said detecting means include switching means to indicate one of a normal state and an abnormal state, and wherein said pulse processing means, responsive to said state indicated by said switching means, provides a data pulse output indicative of at least a preselected one of said states.

5. The monitoring system of claim 4 wherein said switching means indicates said abnormal state and wherein said pulse processing means, responsive thereto, provides a data pulse output indicative of said alarm condition.

6. The monitoring system of claim 1 wherein said detecting means are fire detectors.

7. The monitoring system of claim 6 wherein said fire detectors are smoke detectors.

8. The monitoring system of claim 1 wherein said predetermined characteristic of said data pulse output from said detecting means is pulse width.

9. The monitoring system of claim 8 wherein said detecting means provide a data pulse output having a first pulse width when said monitored variable condition is in said preselected state, and a second pulse width if said monitored variable condition is not in said preselected state.

10. The monitoring system of claim 1 wherein said interrogation means and each of said detecting means preceeding a series connected detecting means repeatedly produce an interrogation pulse output for each monitoring cycle, and wherein said pulse processing means includes means for precluding an indication of a change of state of each of said detecting means unless a data pulse output indicative thereof is received in at least two consecutive monitoring cycles.

11. A condition monitoring system, comprising:

interrogation means providing an interrogation pulse output;

at least first and second detecting means adapted to monitor a predetermined variable condition, each of said detecting means including receiving means for receiving interrogation pulses with said receiving means of said first detecting means being connected with said interrogation means to receive said interrogation pulse outputs therefrom and responsive thereto providing an interrogation pulse output, and with said receiving means of said second detecting means being connected with said first detecting means to receive said interrogation pulse output therefrom, and each of said detecting means, responsive to receipt of said interrogation pulse output coupled thereto, providing a data pulse output having a predetermined characteristic if said monitor variable condition is in a preselected state; and pulse processing means connected with said first and second detecting means to receive said data pulse outputs therefrom and responsive thereto providing an indication of the state of said detecting means, said pulse processing means including memory means and counter means so that said data pulse output is written into said memory means under the control of said counter means, and said pulse processing means also including display means connected with said memory means and said counter means for displaying an indication of said detecting means from which said data pulse output was received and written into said memory means.

12. A condition monitoring system, comprising:

a plurality of detecting stations each of which includes receiving means for receiving interrogation pulses with at least all of said stations except for a last station including pulse interrogation generating means generating an interrogation pulse output, with each of said stations except for a first station being connected with a preceding one of said stations to receive said interrogation pulse output therefrom, and with each of said stations providing a timewise spaced data pulse output indicative of one of two states of a monitored condition;

an interrogation pulse conductor connected with said first detecting station;

a common data conductor connected with each of said detecting stations to receive said timewise spaced data pulses and form a pulse train thereof; and a control unit connected with said interrogation pulse conductor to provide an interrogation pulse output to said first detecting station and with said common data conductor for receiving said train of data pulses from said detecting stations, said control unit including means for processing received data pulses and responsive thereto providing an indication of the state of said monitored condition with respect to each of said detecting stations.

13. The monitoring system of claim 12 wherein said monitoring system includes a power supply conductor and a return conductor each of which is connected in common with all of said detecting stations and with said control unit whereby said control unit is connected with said detecting stations by means of only four conductors.

14. The monitoring system of claim 12 wherein said control unit scans each detecting station once to define a cycle of operation of said system, wherein said control unit repeatedly causes a cycle of operation of said system, wherein a single pulse is generated at said control unit and coupled to said first detecting station on said interrogation pulse conductor at the start of each cycle of operation, and wherein each pulse interrogation generating means of each detecting station generates a signal pulse on said data conductor during each cycle of operation of said system.

15. The monitoring system of claim 13 wherein each of said detecting stations includes means for controlling the pulse width of each data pulse produced, and wherein said control unit senses the width of data pulses in said train of pulse to produce therefrom said indication of the state of said monitored condition of each of said detecting stations.

16. A condition monitoring system, comprising: central interrogation means for periodically providing an interrogation pulse output;

a plurality of detecting stations each of which includes a condition sensing unit for sensing the state of said condition being monitored with each of said detecting stations including data pulse generating means for producing data pulses at least one characteristic of which is controlled by said condition sensing unit with at least all except the last of said detecting stations having interrogation pulse generating means for generating an interrogation pulse output after said data pulse has been generated;

first means for serially connecting said plurality of detecting stations so that said interrogation pulse output is provided in sequence to each of said detecting stations from a first to said last detecting station, said first means also connecting said central interrogation means to said first detecting station so that said interrogation pulse output is coupled to said first detecting station from said central interrogation means;

second means for commonly connecting said plurality of detecting stations to receive said data pulses therefrom, said data pulses forming a train of spaced pulses on said second means; and pulse processing means connected with said second means to receive said train of data pulses therefrom, said pulse processing means responsive to said data pulses providing an indication of the state of said monitored condition at each of said detecting stations.

17. The monitoring system of claim 16 wherein each of said condition sensing units is a smoke detector unit, and wherein said condition being monitored is fire.

18. The monitoring system of claim 16 wherein said central interrogation means provides a single pulse output at the start of each scan of said detecting stations, and wherein each of said detecting means produces a single data pulse during each scan of said detecting stations and each of said detecting stations having said interrogation pulse generating means generating a single interrogation pulse output to the next succeeding detecting station after said single data pulse has been produced.

19. The monitoring system of claim 16 wherein each of said detecting stations is commonly connected with a source of low DC potential and with a return.

20. A fire control scanning system, comprising: central interrogation means providing a single interrogation pulse output at the start of each scan of said system;

a first detecting station having an input connected with said central interrogation means to receive said single interrogation pulse ouput therefrom, said first detecting station providing a single data pulse output in response to receipt of said interrogation pulse from said central interrogation means with said data pulse having a first width if no fire is sensed at said first detecting station and a second width if a fire is detected at said first detecting station, and said first detecting station also having an interrogation pulse generating means providing a single interrogation pulse output after said data pulse has been produced;

a plurality of said second detecting stations each of which has an input for receiving interrogation pulses and provides a single data pulse output in response to receipt of each of said interrogation pulses received at said input with each data pulse having a first width if no fire is sensed and a second width if a fire is sensed, and at least all but a last of said second detecting stations also having an interrogation pulse generating means for providing a single interrogation pulse output after said data pulse has been produced;

first connecting means for connecting said first and second detecting stations in series from said first detecting station to said last detecting station so that each station provides said interrogation pulse output to the next succeeding station;

second connecting means connected to said first and second detecting stations to commonly receive said data output pulses therefrom and form a train of data pulses on said second connecting means;

third connecting means connected to said first and second detecting stations to provide low voltage power thereto;

fourth connecting means connected to said first and second detecting stations to provide a common power return; and data pulse processing means connected with said second connecting means to receive said train of data pulses therefrom and responsive thereto to provide an indication of a fire sensed by any of said detecting stations.

21. The scanning system of claim 20 wherein said system includes a control panel having said central interrogation means and said data pulse processing means included therein, said central panel also being connected with said third and fourth connecting means to supply power and a common return to each of said detecting stations.

22. The fire control scanning system of claim 21 wherein said control panel includes display means connected with said pulse data processing means to display the location of any fire sensed by said detecting station.

23. In a condition monitoring system for sequential scanning of locations to determine the state of a condition being monitored, a detecting station comprising:

input means for receiving interrogation pulses;

a sensing unit for providing at least first and second different indications based upon the sensed state of the condition being monitored;

data pulse generating means connected to said input means and said sensing unit for providing, upon receipt of at least one interrogation pulse at said input means, at least one pulse at a first output from aid detecting station that is indicative of said state of the condition of said sensing unit; and interrogation pulse generating means connected with at least one of said data pulse generating means and said input means for producing at least one interrogation pulse at a second output from said detecting station after said interrogation pulse has been received at said input means.

24. The detecting station of claim 23 wherein said data pulse generating means includes a pulse width modulator for producing data pulses having a first width if a first state of said monitored condition is sensed and a second if a second state of said monitored condition is sensed.

25. The detecting station of claim 23 wherein said interrogation pulse generating means is connected to said pulse width modulator to receive said data pulse output therefrom and responsive thereto generating said interrogation pulse output after said data pulse has been generated.

26. The detecting system of claim 25 wherein said system includes delay means connected between said interrogation pulse generating means and said pulse width modulator.

27. The detecting station of claim 23 wherein said sensing unit is an ionization smoke detector, and wherein the width of said data pulses are indicative of fire and no fire sensed conditions.

28. The detecting station of claim 27 wherein said first pulse width is greater than said second pulse width with said greater width being indicative of a sensed fire.

29. In a condition monitoring system for sequential scanning of detecting station producing data pulses during each scan of said detecting station with each said data pulse having a width indicative of the state of the condition being monitored and with said data pulses being outputted on a common data line, a pulse processing unit, comprising:

receiver means for receiving said data pulses on said common data line;

a pulse width discriminator connected with said receiver means for providing an output only if the width of said data pulse is greater than a predetermined width;

logic circuitry connected with said pulse width discriminator to provide an output only if an output is received from the pulse width discriminator in two consecutive scans corresponding to data pulses from the same detecting station;

pulse counter means connected with said receiver means to receive said data pulses therefrom and count the same;

memory means connected with said logic circuitry and with said counter means to store an indication of any detecting station which has provided the necessary data pulses to cause said logic circuitry to provide an output to said memory means;

display means connected with said pulse counter means and said memory means for displaying said indication stored in said memory; and control means connected with said pulse counter means and said memory means for controlling entry of said indications into said memory means and display of said indications so stored.

30. The pulse processing unit of claim 29 wherein said control means includes READ/WRITE logic circuitry and a pulse generator, and wherein said READ/-WRITE logic circuitry provides an interrogation output pulse for initiating each scan of said system.

31. The pulse processing unit of claim 29 wherein said unit includes trouble logic circuitry connected with said memory means and said counter means for automatically indicating trouble in said system.

* * * * *

UNITED STATES PATENT AND TRADEMARK OFFICE

CERTIFICATE OF CORRECTION

PATENT NO. : 4,290,055

DATED : September 15, 1981

INVENTOR(S) : Douglas E. Furney; Michael J. Muldrey

It is certified that error appears in the above—identified patent and that said Letters Patent is hereby corrected as shown below:

Column 10, line 51, delete "Q" and insert --$\overline{Q}$--

Column 11, line 56, delete "$\overline{Q}$" and insert --Q--

Column 12, line 9, delete "Q" and insert --$\overline{Q}$--

Column 12, line 22, delete "resistor" and insert --resistors--

Column 12, line 67, delete "in" and insert --if--

Column 14, line 23, delete "counter" and insert --counters--

Column 14, line 62, detele "RAm" and insert --RAM--

Column 14, line 64, delete "writted" and insert --written--

Column 16, line 4, detele "526-523" and insert --526-532--

Column 20, line 13, delete "the" and insert --that--

Column 20, line 36, delete "715" and insert --714--

Column 21, line 47, delete "RESET2" and insert --$\overline{\text{RESET2}}$--

UNITED STATES PATENT AND TRADEMARK OFFICE

CERTIFICATE OF CORRECTION

PATENT NO. : 4,290,055 Page 2 of 2

DATED : September 15, 1981

INVENTOR(S) : Douglas E. Furney; Michael J. Muldrey

It is certified that error appears in the above—identified patent and that said Letters Patent is hereby corrected as shown below:

Column 22, line 11, delete "BUZZILSW4" and insert --BUZZILSW4--

Column 22, line 57, delete "FIRE" and insert --FIRE--

Column 22, line 58, delete "FIRE" and insert --FIRE--

Column 27, line 62, delete "(200010-2)" and insert --(20010-2)--

Column 29, line 49, delete "TPCNTDLY" and insert --TPCNTDLY--

Column 31, line 22, after "and", should start a new paragraph

Column 32, line 19, after "comprising:", should start a new paragraph

Column 33, line 67, delete "aid" and insert --said--

Signed and Sealed this

Fifth Day of October 1982

[SEAL]

Attest:

GERALD J. MOSSINGHOFF

Attesting Officer

Commissioner of Patents and Trademarks